US005617121A

United States Patent [19]

Tachihara et al.

[11] Patent Number: 5,617,121

[45] Date of Patent: Apr. 1, 1997

[54] INK JET RECORDING WITH INK DETECTION

[75] Inventors: Masayoshi Tachihara, Chofu; Yasuyuki Tamura, Yokohama, both of Japan

[73] Assignee: Canon Kabushiki Kaisha, Tokyo, Japan

[21] Appl. No.: 452,866

[22] Filed: May 30, 1995

Related U.S. Application Data

[63] Continuation of Ser. No. 77,949, Jun. 18, 1993, abandoned, which is a continuation of Ser. No. 659,698, Feb. 25, 1991, abandoned.

[30] Foreign Application Priority Data

Feb. 26, 1990 [JP] Japan ..... 2-46289
Jun. 8, 1990 [JP] Japan ..... 2-148551

[51] Int. Cl.[6] ..... B41J 2/175

[52] U.S. Cl. ..... 347/7

[58] Field of Search ..... 347/7

[56] References Cited

U.S. PATENT DOCUMENTS

| | | | |
|---|---|---|---|
| 1,907,845 | 5/1933 | Macrae | 340/622 X |
| 2,783,341 | 2/1957 | Wisman | 340/622 X |
| 3,603,927 | 9/1971 | Osborne | 73/295 X |
| 4,313,124 | 1/1982 | Hara . | |
| 4,313,684 | 2/1982 | Tazaki | 347/37 X |
| 4,345,262 | 8/1982 | Shirato et al. . | |
| 4,459,600 | 7/1984 | Sato et al. . | |
| 4,463,359 | 7/1984 | Ayata et al. . | |
| 4,550,327 | 10/1985 | Miyakawa | 347/67 |
| 4,558,333 | 12/1985 | Sugitani et al. . | |
| 4,604,633 | 8/1986 | Kimura et al. | 346/140 R |
| 4,723,129 | 2/1988 | Endo et al. . | |
| 4,740,796 | 4/1988 | Endo et al. . | |
| 5,051,759 | 9/1991 | Karita | 347/87 |

FOREIGN PATENT DOCUMENTS

| | | | |
|---|---|---|---|
| 3344447 | 6/1984 | Germany . | |
| 54-056847 | 5/1979 | Japan | B41M 5/26 |
| 57-100077 | 6/1982 | Japan | B41J 3/04 |
| 58-004678 | 1/1983 | Japan | B41J 3/04 |
| 59-123670 | 7/1984 | Japan | B41J 3/04 |
| 59-138461 | 8/1984 | Japan | B41J 3/04 |
| 2370 | 1/1985 | Japan | B41J 3/04 |
| 60-071260 | 4/1985 | Japan | B41J 3/04 |
| 61-98542 | 5/1986 | Japan | B41J 3/04 |
| 61-202850 | 9/1986 | Japan | B41J 3/04 |
| 2003322 | 1/1990 | Japan | B41J 2/175 |

*Primary Examiner*—Joseph W. Hartary
*Attorney, Agent, or Firm*—Fitzpatrick, Cella, Harper & Scinto

[57] ABSTRACT

A recording head comprises discharge ports for discharging ink, a liquid chamber for reserving the ink to be supplied to the discharge ports, a liquid channel for connection between the discharge ports and the liquid chamber, discharge energy generating elements for generating the energy used for the discharge of ink which is provided within the liquid channel, and an ink detection element provided in the liquid chamber for detecting the presence of ink.

45 Claims, 16 Drawing Sheets

INK JET RECORDING WITH INK DETECTION

This application is a continuation of application Ser. No. 08/077,949 filed Jun. 18, 1993, now abandoned, which in turn is a continuation of application Ser. No. 07/659,698 filed Feb. 25, 1991, now abandoned.

BACKGROUND OF THE INVENTION

1. Field of the Invention

The present invention relates to a recording apparatus applicable to office or telecommunication equipment such as a copying machine, a facsimile terminal equipment, a word processor, office computer and the like. And more particularly, the present invention relates to an ink jet recording apparatus and method for detecting recording liquid wherein the recording is performed by discharging the ink to form ink droplets, which are made to stick onto a recording medium such as a paper.

2. Related Background Art

Recently, the ink jet recording apparatus has been used much more due to the advantages of excellent print quality, recording speed, quietness during operation, and easiness of coloring.

An ink jet recording head (thereafter referred to as head) equipped in such a recording apparatus is largely classified into two types, depending on the preservation state of ink.

The first type is one in which the replacement is not presumed as a rule (thereafter referred to as a permanent type) as a storage container of ink is provided outside of a head body to supply the ink within the storage container to the head by means of a supply tube. With this type of head, if the ink has been exhausted, the recording can be resumed by refilling the ink into the storage container, or exchanging each storage container. It should be noted that a type being able to replace only a recording head or storage container independently is contained in this type. The second type is one in which a storage container of ink is provided integrally with a head body (thereafter referred to as disposable type), and at the time when the ink within the storage container is used up, the entire head and storage container are replaced.

By the way, with such an ink jet recording apparatus, if a little ink remains, or dries within a liquid channel or dries and fixes on a portion of discharge ports for discharging liquid because it is not used for a long time, the recording may not be often carried out without blurred recorded characters.

In a recording head provided with the elements such as electricity-heat converters generating the heat energy which is used for discharging ink, a so-called idle heating state occurs when the ink does not exist in the vicinity of heat energy generating elements, so that there is a high possibility that electricity-heat converters or component members of liquid channels are damaged, as well as a failure in recording. More specifically, an example of a recording apparatus with a head in such a method is a recording apparatus which is provided with electricity-heat converters within a liquid channel of ink in the vicinity of ink discharge ports, causing the film boiling in the ink with the heat energy which the electricity-heat converters generate, and discharges the ink with the growth of bubbles due to the film boiling.

The above-mentioned problem must be of course avoided in the permanent type, while it is also taken into consideration to avoid unnecessary replacement of recording head or abrupt stop of recording in the disposable type.

Conventionally, in the permanent type, a method has been proposed for detecting whether a little ink remains, based on a reduced amount of ink pressure, with a pressure sensor provided within the storage container or ink. While in the disposable type, another method has been proposed for detecting whether a little ink remains, based on changes of the electric conductivity of ink within the storage container of ink.

However, there are following problems for detecting remaining ink with those methods.

First, with a recording head for use in a serial recording apparatus where the recording is conducted by moving the head back and forth in a reciprocatory motion along a recording medium (recording paper), the ink undergoes changes along with the movement of the head engaged, causing a fluctuation of the liquid surface to be measured, so that a detected amount of ink pressure or electric conductivity is varied to bring about a malfunction in detecting remaining ink.

Second, with the above-mentioned method, it is difficult to detect immediately before the ink is exhausted completely, as no ink is detected in a condition where the ink still remains, so that the ink can not be used until its full amount, leaving some waste. Further, owing to the ink leaking from a discarded storage container of ink, the surroundings may be stained.

Thus, a recording apparatus and method for detecting ink is desired wherein it is provided with the feature for reliably detecting immediately before the ink is exhausted completely, so as to be able to use the ink until its full amount.

On the other hand, U.S. Pat. No. 4,550,327 discloses a liquid droplet discharge apparatus in which the liquid within a nozzle is discharged by use of the heat energy, and in which a plurality of nozzles each comprises a conductor section in the inside thereof, and the state of liquid within each nozzle is sensed by detecting changes of current value flowing through the conductor section.

However, there are some occasions where as the conductor section is provided within each nozzle and abuts on a heat energy generating element for discharging liquid, the heat energy caused by the conductor section has an effect on the discharge of liquid. And as there is a necessity of providing the conductor section for each nozzle, the manufacturing process is complex, resulting in a higher manufacturing cost.

Further, as the conductor section exists within nozzle, the recording is stopped simultaneously with the sensing of no liquid within nozzles.

SUMMARY OF THE INVENTION

The present invention was invented, based on the above-mentioned background technologies, and a new view that was not conventionally foreseen. The present invention is intended to resolve the technical problems concerned with the above-mentioned background technologies, and it is an object of the invention to provide a recording apparatus and method for detecting liquid wherein whether or not a little liquid remains can be reliably detected.

It is an object of the present invention to provide a recording apparatus and method for detecting recording liquid wherein the recording liquid can be effectively used for almost 100%, and the reliability in detecting remaining ink can be raised without having any effect on the discharge of recording liquid.

Further, it is an object of the present invention to provide a recording apparatus and method for detecting recording liquid wherein the waste of recording liquid can be eliminated, thereby resolving the problem of staining the surroundings with the leakage of recording liquid from a discarded storage container of recording liquid.

It is another object of the present invention to provide a first recording head comprising:

discharge ports for discharging ink, a liquid chamber for reserving the ink to be supplied to said discharge ports, a liquid channel for connection between said discharge ports and said liquid channel, discharge energy generating elements for generating the energy used for the discharge of ink which is provided within said liquid channel, and ink detection elements for detecting the presence of ink which is provided in said liquid chamber.

Further, it is another object of the present invention to provide a recording apparatus characterized by comprising an ink detection section for detecting the presence of ink within said liquid chamber, based on the information from said ink detection elements of said first recording head.

Further, it is another object of the present invention to provide a method for detecting ink characterized by detecting the presence of ink within said liquid chamber of said first recording head.

Further, it is another object of the present invention to provide a second recording apparatus comprising:

discharge ports for discharging ink, a liquid chamber for reserving the ink to be supplied to said discharge ports, a liquid channel for connection between said discharge ports and said liquid channel, discharge energy generating elements for generating the energy used for the discharge of ink which is provided within said liquid channel, and heating elements provided in said liquid chamber, said heating elements being broken when the ink does not exist in the vicinity of said heating elements, while not being broken when the ink exists in the vicinity of said heating elements if a predetermined electrical signal is supplied.

Further, it is another object of the present invention to provide a recording apparatus characterized by comprising a control section for applying said predetermined electrical signal to said second recording head in a predetermined timing, and an ink detection section for detecting the presence of ink within said liquid chamber depending on the breakage with said heating elements.

Further, it is another object of the present invention to provide a method for detecting ink characterized by detecting the presence of ink within said liquid chamber depending on the breakage of said heating elements, by applying to said heating elements of said second recording head such an electrical signal that said heating elements being broken when the ink does not exist in the vicinity of said heating elements, while not being broken when the ink exists in the vicinity of said heating elements.

Further, it is another object of the present invention to provide a third recording apparatus comprising:

discharge ports for discharging ink, a liquid chamber for-reserving the ink to be supplied to said discharge ports, a liquid channel for connection between said discharge ports and said liquid channel, discharge energy generating elements for generating the energy used for the discharge of ink which is provided within said liquid channel; and a resistor provided on a portion except for said liquid channel of said recording head, said resistor having the variable electrical resistance varying with the temperature change depending on the presence of ink within said recording head.

Further, it is another object of the present invention to provide a recording apparatus characterized by an ink detection section for detecting the presence of ink within said recording head, based on the change of electrical resistance in said resistor of said third recording head.

Further, it is another object of the present invention to provide a method for detecting ink characterized by detecting the presence of ink within said recording head, based on the change of electrical resistance in said resistor of said third recording head.

According to the present invention, a recording head comprises heating elements within an ink liquid chamber thereof, wherein the presence of ink within said liquid chamber is reliably sensed by making use of a large change of temperature in the heating elements corresponding to the presence of ink, i.e., a little increase of temperature due to the heat radiation to the ink when the ink exists, and a rapid rise in temperature with no heat radiation to the ink when the ink does not exist, and detecting the large change of temperature by means of a thermal detector.

According to another embodiment of the present invention, the presence of ink within said liquid chamber can be reliably sensed in accordance with the presence of breakage in heating elements provided within said liquid chamber, in which the heating elements will be broken when the ink does not exist in the vicinity of said heating elements, while not being broken when the ink exists in the vicinity of said heating elements, if a predetermined signal is supplied. And, thus the ink is fully used without waste, by reliably detecting the time immediately before the ink is completely used up, based on the presence of ink within the liquid chamber that was so detected.

DETAILED DESCRIPTION OF THE PREFERRED EMBODIMENTS

The examples of the present invention will be described with reference to the drawings.

EXAMPLE 1

FIGS. 1 to 5 are views for explaining a first example of the present invention. This example is one applied to an ink jet recording apparatus of the disposable type as previously described, in which electricity-heat converters are used as discharge energy generating elements, with the recording apparatus having a serial recording head which scans the recording head in a predetermined direction to a recording medium.

Figure 8:
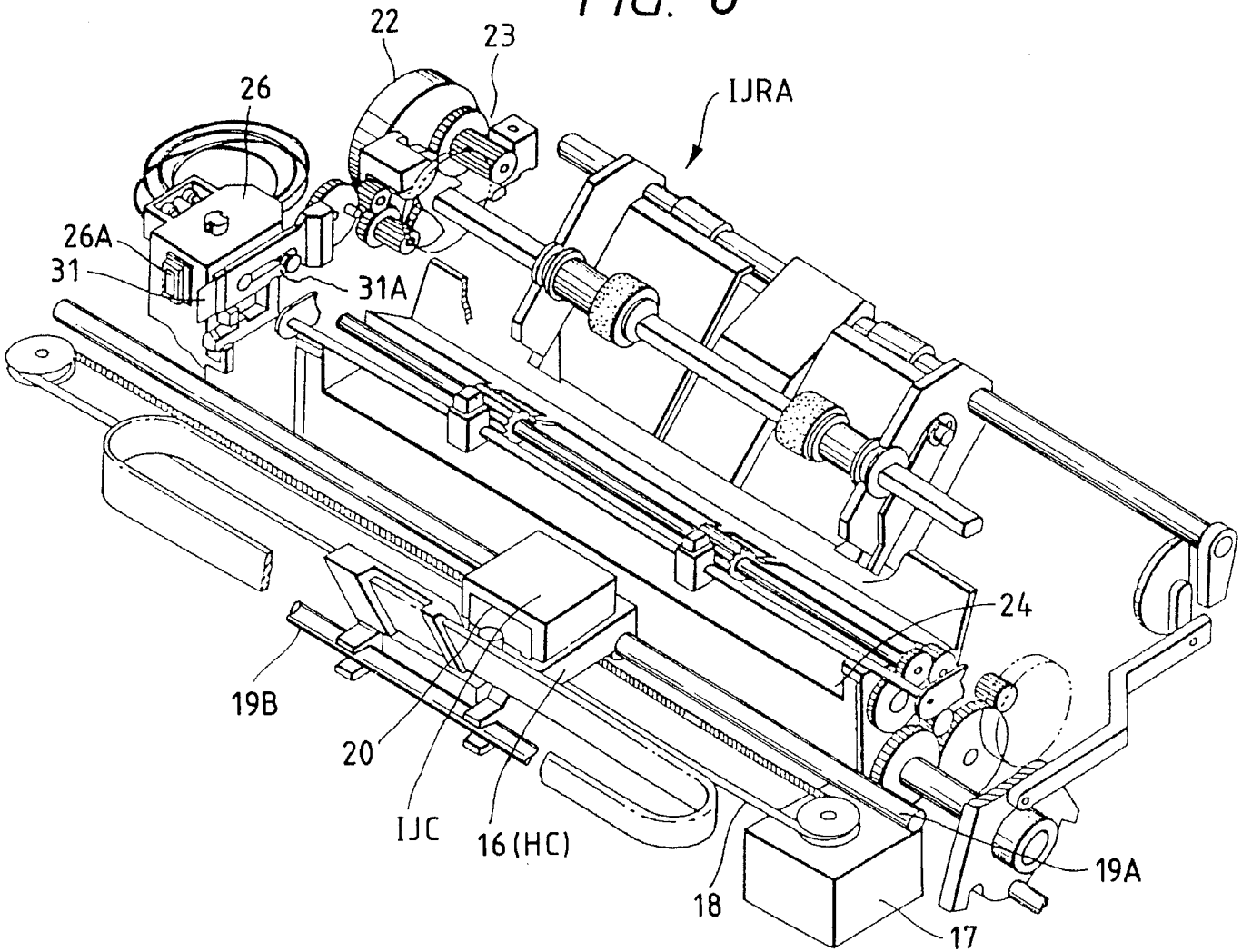
FIG. 8 is a typical external perspective view showing a preferred example of a liquid jet recording apparatus in the first example.

FIG. 8 is a typical external perspective view showing a preferred example of a liquid jet recording apparatus (ink jet recording apparatus) IJRA with the above-mentioned ink remaining detecting method.

In the figure, 20 is a liquid jet recording head comprising a group of nozzles for effecting the ink discharge on a recording paper (not shown) fed onto platen 24, in the form of a cartridge integrally formed with an ink storage container.

16 is a carriage HC for carrying the recording head 20, in which it is connected to a part of a driving belt 18 for transmitting the driving force of a driving motor 17, and slidably supported with two guide shafts 19 and 19B disposed parallel to each other so that it can move in the reciprocatory motion across a full width of the recording paper with the recording head 20.

26 is a head recovery device which is disposed at one end of the movement path, e.g., a position opposed to the home position, for the recording head 20. The head recovery device 26 is caused to operate with the driving force of the motor 22 via gear 23, effecting the capping of the recording head 20. In conjunction with the capping of a cap section 26A of the head recovery device 26 to the recording head 20, the discharge recovery process is performed by forcedly discharging the ink through discharge ports to remove thickened ink within nozzles, and effecting the ink suction with appropriate suction means provided within the head recovery device 26, or the ink can be force fed with appropriate pressure means provided on an ink supply channel to the recording head 20. Further, the recording head can be protected by the capping provided at the termination of recording.

31 is a blade which is a wiping member formed by a flexible material such as silicone rubber and disposed on a side of the head recovery device 26. The blade 31 is carried by a blade holding member 31A in the cantilever form, operating by the motor 22 and the gear 23 like the head recovery device 26, and allowing the engagement with a discharge face of the recording head 20. Thereby, at an appropriate timing in the recording operation of the recording head 20 or after the discharge recovery processing by means of the head recovery device 26, the blade 31 is projected to the movement path of the recording head 20, in order to wipe out dew condensation, unnecessary recording liquid or dust on the discharge face of the head 20 along with the movement of the head 20.

Figure 9:
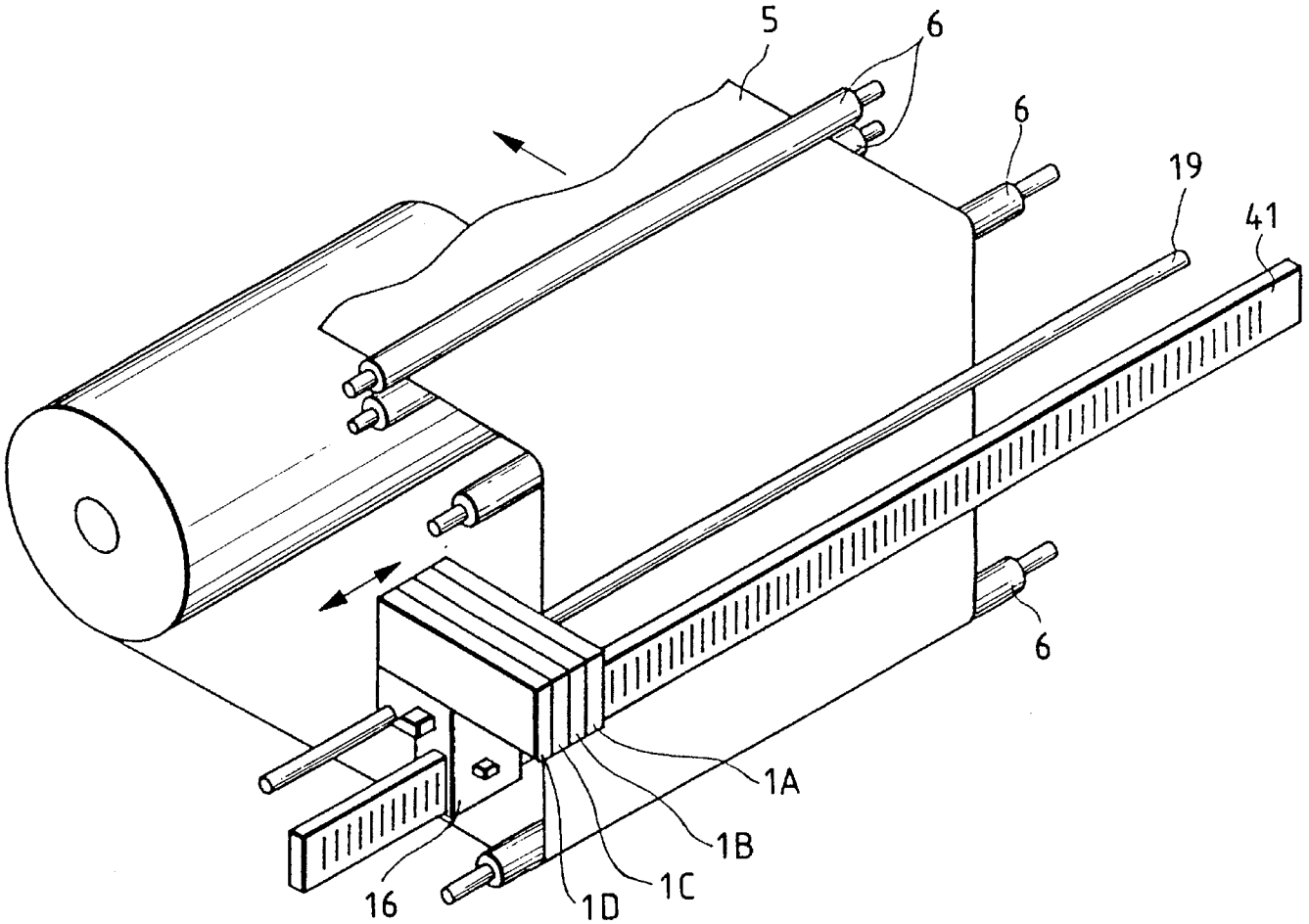
FIG. 9 is a typical external perspective view showing another preferred embodiment of a liquid jet recording apparatus in the first example.

On the other hand, FIG. 9 is a typical external perspective view showing a preferred example of a liquid jet recording apparatus having a recording head for color recording.

In FIG. 9, 1A, 1B, 1C and 1D are recording heads for discharging the color inks of yellow, magenta, cyanogen and black, respectively, and installed on the carriage 16.

These recording heads 1A, 1B, 1C and 1D are of the disposable type formed integrally with ink storage sections that are supply sources of respective ink. The carriage 16 moves crosswise along the guide shaft 19, with its move position being detected by an encoder 41. A recording paper (recording medium) is fed by being guided by a plurality of feed rollers 6 which are installed at the upper and lower sides thereof, and which at a position opposed to ink discharge port formation faces (thereafter referred to as simply discharge faces) for the recording heads 1A, 1B, 1C and 1D, it is carried opposed parallel to those discharge faces.

Figure 1A:
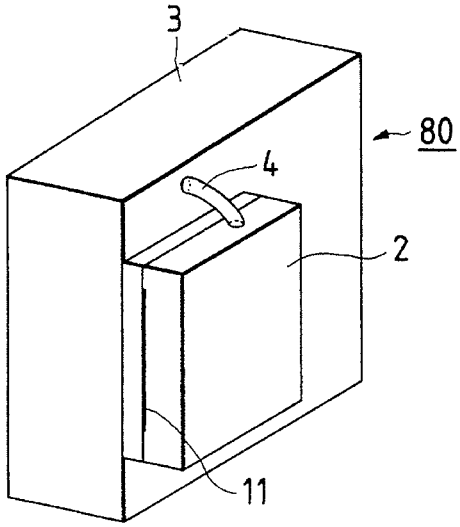
FIG. 1A is a typical perspective view of a recording head.
Figure 1B:
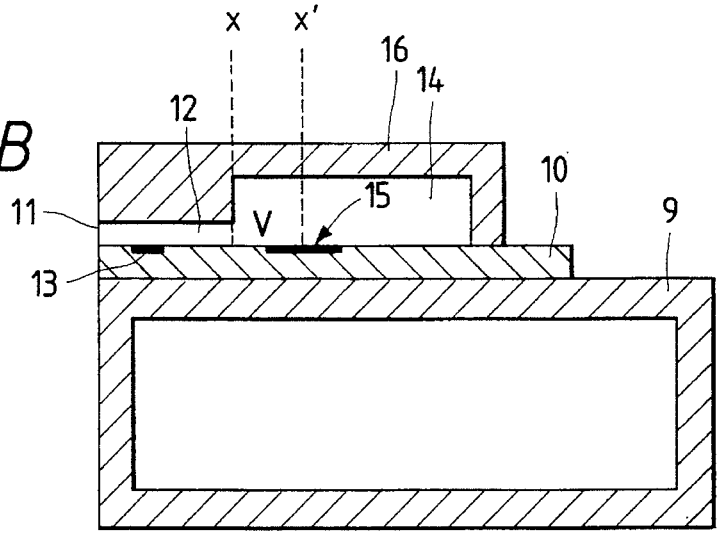
FIG. 1B is a typical cross-sectional view of the recording head as shown in FIG. 1A.
Figure 1C:
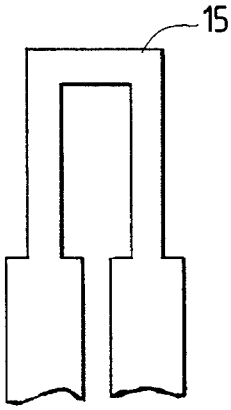
FIG. 1C is a typical plan view of the above-mentioned heating elements.

FIGS. 1A and 1B are views for explaining one example of a recording head preferably used in the present invention, and FIG. 1C is a view for explaining a heat generating element for detecting the quantity of recording liquid. FIG. 1A is a typical perspective view of the recording head, FIG. 1B is a typical cross-sectional view of the recording head as shown in FIG. 1A, and FIG. 1C is a typical plan view of the above-mentioned heat generating element.

Figure 1D:
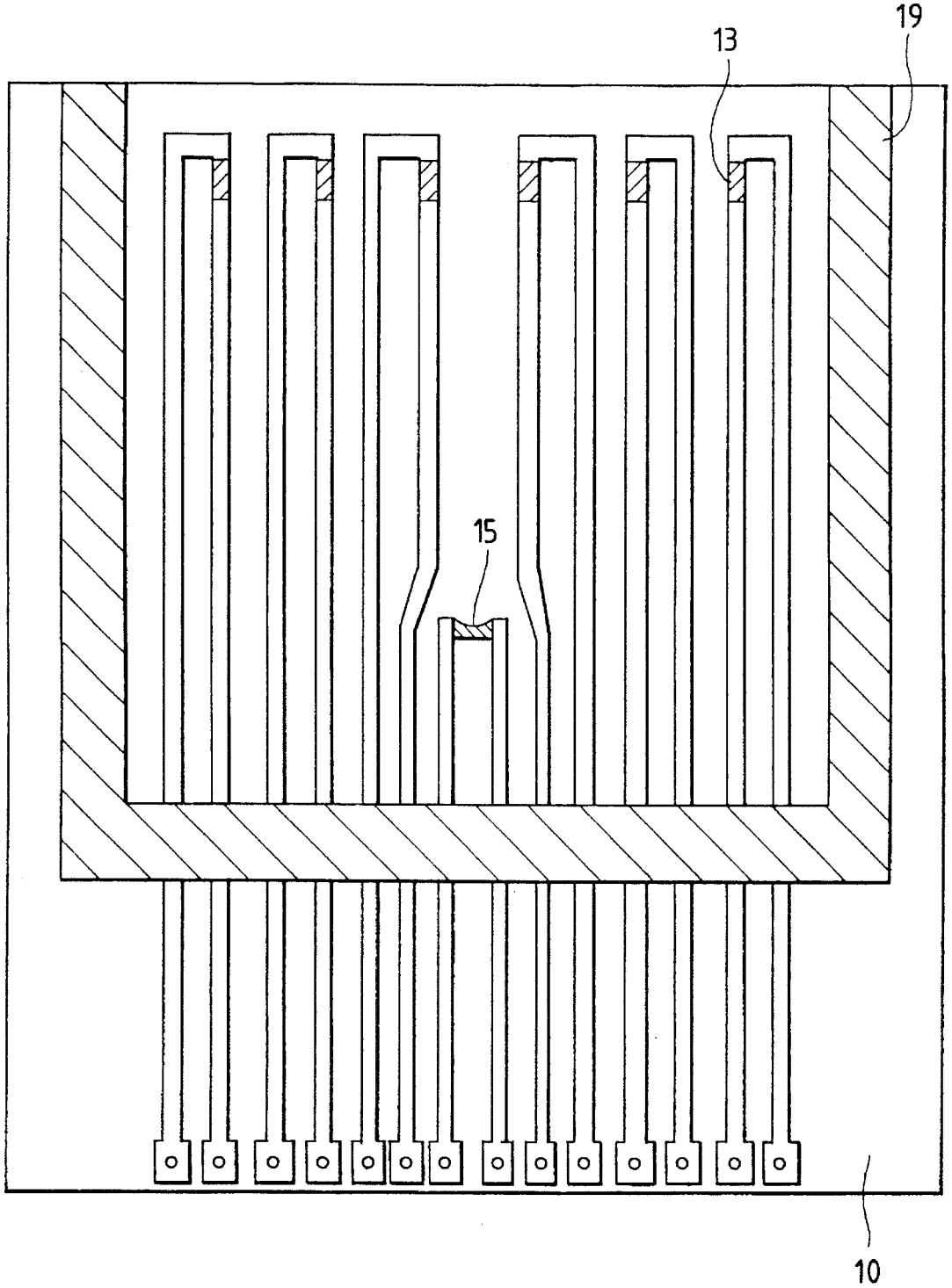
FIG. 1D is a typical plan view of a substrate in the recording head as above shown.

FIG. 1D is a typical plan view of a substrate of the recording head as above shown.

Each of the recording heads 1A, 1B, 1C and 1D is constructed as shown in FIG. 1A.

In FIGS. 1A and 1B, 80 is an ink cartridge, 2 is a recording head, 3 is a recording liquid storage section (reserving section), and 4 is a tube for supplying recording liquid from the recording liquid storage section (reserving section) to the recording head. 10 is a substrate made of Si or the like, 11 is a discharge port, 12 is a liquid channel, 13 is a discharge energy generating element provided in the liquid channel, 14 is a liquid chamber communicating to the liquid channel 12 as above indicated, 15 is a heat generating element provided within the liquid chamber, and 16 is a ceiling plate made of glass or the like. Note that a plurality of liquid channels are separated by walls made of photosensitive resin that was set.

FIG. 1D is a typical plan view showing the state where a discharge energy generating element 13 and a heat generating element 15 are provided on the substrate 10. As can be clearly seen from the figure, according to the present invention, the heat generating element 15 is not necessary to provide for each nozzle, but is sufficient if one is provided in the liquid chamber, resulting in easier manufacture and lower cost. A reference numeral 19 denotes a side wall of the liquid chamber.

The ink cartridge 80 is formed by integrally connecting the recording head 2 and the ink storage section 3, and is detachable from the body of the recording apparatus. The recording head 20 is comprised of a junction structure of a substrate 10 of Si and a ceiling plate 16 of glass, and on the discharge face side at such junction are formed a plurality of discharge ports 11 arranged in the upward and downward directions.

The discharge ports 11 communicate through a plurality of liquid channels 12, respectively, to one common liquid chamber (liquid compartment) 14. The wall sections at the interconnections of a plurality of liquid channels 12 are formed of, for example, ultraviolet radiation set resin. The common liquid chamber 14 is communicated via the tube 4 into the ink storage section 3.

On an upper surface of the substrate 10 are formed a plurality of discharge energy generating elements (electricity-heat converters) which are located one within each liquid channel 12, and the wirings of Al or the like for supplying the electricity to each of these discharge energy generating elements, individually, with the film technique. And one heat generating element is provided at a position near the liquid channel 12 within the common liquid chamber 14.

The heat generating element 15 is made of Al which is deposited by the evaporation within the liquid chamber, preferably, in the vicinity of a trailing end of the liquid channel 12 (flow inlet port) within the liquid chamber, with the thickness being about 5000Å. The Al resistor is protected by a $SiO_2$ film having a thickness of 1.0 μm and a Ta film having a thickness of 0.2 μm.

Between the above-mentioned Al film and the substrate 10 are formed $HfB_2$ which is a resistance material for the discharge energy generating elements 13 within the liquid channel and/or an electrode, for reasons of the process. The above-mentioned resistance material is formed on the $SiO_2$ film of thermal oxidation having a thickness of 5.0 μm, which has been formed on the substrate 10.

The above-mentioned Al resistor 15 is U-shaped, having a width of 5 μm and a total length of 682 μm. A sheet resistance of the above-mentioned Al resistor is about 0.054 Ω at the normal temperature, and about 0.22 Ω at 680° C. near the fusion point, and varies almost linearly within this temperature range.

Accordingly, the resistance value of the Al resistor 15 having the dimension as above indicated is about 7.4 Ω at the normal temperature, and about 30 Ω at 680° C.

With the above constitution, if the pulsed voltage is applied to the above-mentioned Al resistor 15, the above-mentioned resistor will generate the heat energy corresponding to the applied power. When the voltage is applied to the above-mentioned Al resistor, the temperature of the same resistor will rise more rapidly with no recording liquid on the same resistor than with recording liquid thereon.

This is because the recording liquid has a higher thermal conductivity than the air or the water vapor, and the heat energy generated by application of the above-mentioned electric pulses can more easily transmit to the recording liquid on the same resistor.

In the present invention, with a method of applying electric pulses so that the same resistor will be fused or broken when there is no recording liquid on the same resistor, the exhaustion of recording liquid can be reliably detected.

It should be noted that when the proper amount of recording liquid is contained, e.g. in the recording head of the disposable type as previously described, the detection of its breakage can be used as a signal indicating that the life span of the recording head has been reached.

Figure 2:
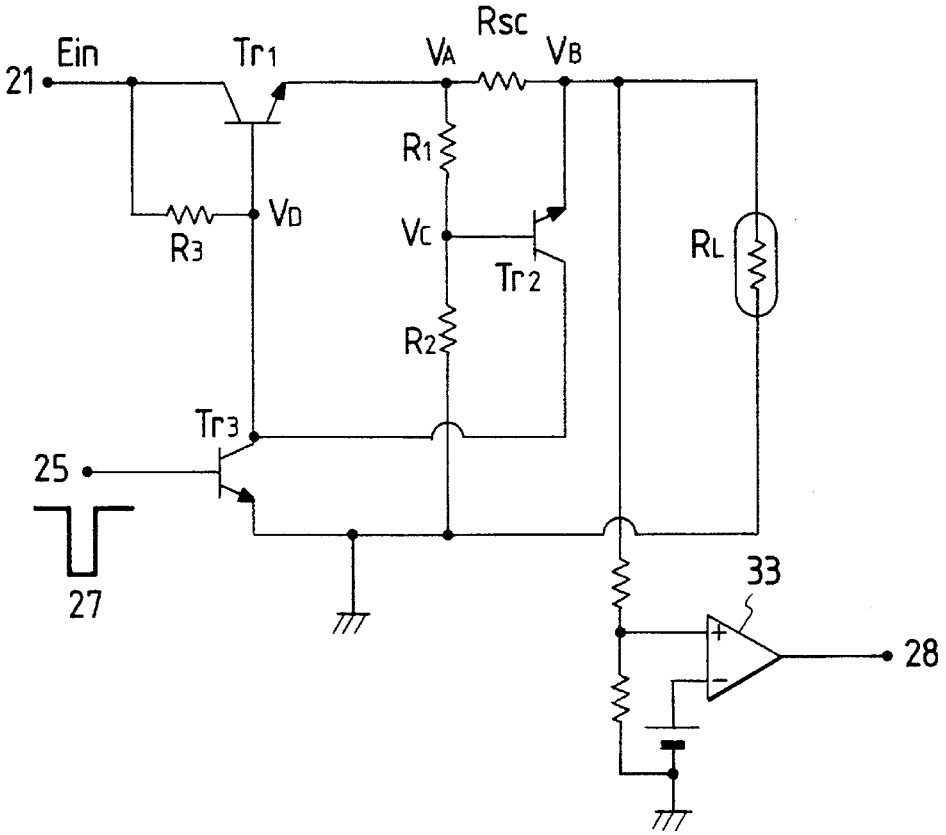
FIGS. 2 and 4 are circuit diagrams for detecting the electrical resistance to which heating elements are connected in the first example.

A circuit as shown in FIG. 2 is an example for supplying the electric power to the Al resistor as previously described, generally called a holdback type current limiting circuit.

Figure 3:
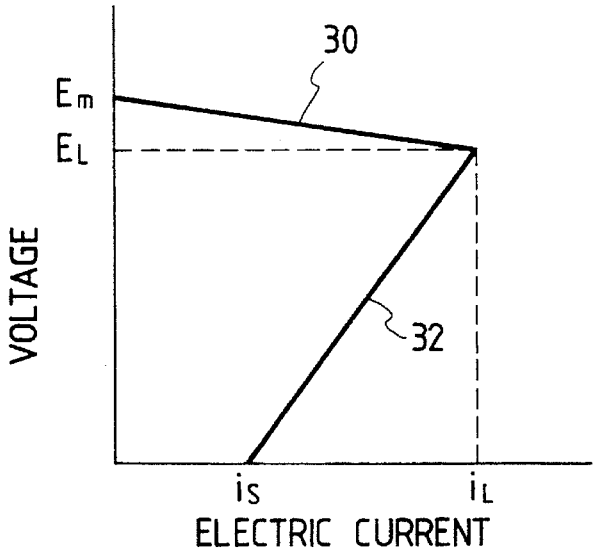
FIG. 3 is a V-I characteristic graph representation for a current limiting circuit in the first example.

When the DC voltage $E_{in}$ and pulse signals 27 are supplied to 21 and 25, respectively, the relation between the voltage E applied to a load resistor $R_L$ and the electric current is shown in FIG. 3. The characteristic along a line 30 or 32 is shown depending on the value of the load resistor $R_L$. In FIG. 3, $E_m$, $E_L$, $i_S$, and $i_L$ are given by the following formulas.

$$E_m=E_{in}-V_{BE} \quad (1)$$

$$E_L=E_m-i_L R_{SC} \quad (2)$$

$$i_s=(V_{BE}/R_{SC}).(R_1+R_2)/R_2 \quad (3)$$

$$i_L=V_{BE}/R_{SC}+R_1/(R_1+R_2).E_m/R_{SC} \quad (4)$$

Where $E_m$ is a voltage at $V_A$ when $R_L$ has no load, $E_L$ is a voltage at $V_B$ when the maximum current $i_l$ flows through $R_L$, $i_s$is a current through $R_L$ when the resistance of $R_L$ is assumed to be zero, and $V_{BE}$ is a voltage difference between base and emitter of a transistor $Tr_1$, about 0.6 volts. The feature of this circuit is that if the load resistance $R_L$ is less than or equal to $E_L/i_L$, the consumed power is an increasing function of resistance value. That is, if $R_L$ increases with the rise in temperature, the consumed power will increase still more. Accordingly, if the heat radiation property varies depending on whether or not the recording liquid exists in the vicinity of this resistor, the consumed power largely changes. Thus, by appropriately selecting the circuit constants, it is possible to cause the same resistor to be heated and broken, when there is no recording liquid within the liquid chamber.

In this example, $E_{in}$=20 V, $E_m$=19.4 V, $R_{SC}$=4.7 Ω, $R_1$=330 Ω, $R_2$=3.3 k Ω.

Note that $E_{in}$=20 V was set at the same value as the discharge voltage. $E_{in}$ is sufficient if it is above that value.

If electric pulses having a pulse width of 7μ sec are supplied to 25 in FIG. 2 with the voltage value as above indicated, the resistor broke instantly with a single pulse when there is no recording liquid within the liquid chamber. On the other hand, the voltage applied to $R_L$ rises rapidly at the instant when the resistor is broken within the liquid chamber, and the breakage is detected with a comparator and a signal appears at 28. The breakage detection signal output at 28 is input to a microcomputer provided, which outputs a recording terminal signal to recording means, with an indication on display means. When the recording liquid existed, the resistor was not broken even with 106 times of electric pulses in the condition as above indicated. In accordance with a calculation of heat conduction, when the recording liquid does not exist with the liquid chamber, it is expected that the temperature of the resistor Al will exceed a melting point of about 700° C. in about 5μ sec after a pulse is applied. At this time, the electric power supplied to the same resistor was about 4.4 W.

On the other hand, when the recording liquid exists within the liquid chamber, the maximum temperature of the Al resistor only reaches 210° C., if the above-mentioned electric pulse is supplied, where it is expected that the consumed power of the same resistor is about 1.1 W.

The interval with which the above-mentioned electric pulses are supplied to the same resistor depends on the size of the liquid chamber, but in this example, is the period for which the head prints one line. If the operation for removing bubbles within the head (recovery operation) is performed by means of a recovery pump, the same pulse is preferably supplied immediately after that interval.

The operation of this circuit will be described.

First, if an electric pulse 27 is supplied to 25 in the circuit as shown in FIG. 2, a transistor $Tr_3$ is turned off, causing the base voltage of transistor $Tr_1$ to be 0.6 V and turned on.

Defining each potential of $V_A$, $V_B$, $V_C$ and $V_D$ as shown in FIG. 2, $V_B=0$ when $R_L=0$, and the current flowing through $R_L$ is substantially the same as that flowing through $R_{SC}$ because the collector current of $Tr_2$ is small. Thus $V_A$ and $V_C$ are determined such that $V_C-V_B=V_C=0.6$ V.

At this time, the current i flows through $R_3$, and the following relations are obtained.

$$E_{in}-R_3 i_3=V_D \quad (5)$$

$$V_D-0.6\ \text{V}=V_A \quad (6)$$

As $V_C-V_B=V_C=0.6$ V, the transistor $Tr_2$ is also turned on. Here the resistor $R_C$ has its resistance value increased because of the rise in temperature with the heating, causing the potential $V_B$ to rise, and also the potential $V_C$ to rise by the increased amount of $V_B$, with the relation $V_C-V_B=0.6$ V.

As $V_A$ is $(R_1+R_2)/R_2$ times the increased width of $V_C$, $V_A$ also increases more than the increased width of $V_B$ ($\Delta V_B=\Delta V_C$; $\Delta V_A=\{(R_1+R_2)/R_2\}\Delta V_C$). Accordingly, $V_A-V_B$ will increase. Along with it, the current flowing through $R_{SC}$ will increase, and the current flowing through $R_L$ will also increase. This state is indicated by a region 32 as shown in FIG. 3. Note that the axis of ordinates is indicated by the value $V_B$.

By the way, as the expressions (5) and (6) as previously indicated stand, the current $i_3$ flowing through $R_3$ decreases, while $V_D$ increases.

Thereafter, the resistance value of $R_L$ increases with the rise in temperature due to the heating of $R_L$, causing $i_3$ to be decreased to approach zero, thereby $V_D$, $V_A$, $V_C$ and $V_B$ increasing, with an upper limit of $V_A$ being $E_{in}-0.6$ V, so that $V_C-V_B=0.6$ V can not be held in the meantime, and when $V_C-V_B<0.6$, $Tr_2$ is turned off, with the current only flowing in the sequence of from 21 through $Tr_1$, through $R_{SC}$ to $R_L$. This state is indicated by a region 30 as shown in FIG. 30.

In this way, if the resistance value of $R_L$ increases with the rise in temperature of $R_L$, the consumed power will increase, causing $R_L$ to be heated and broken. At the instant of breakage, the voltage applied to $R_L$ increases rapidly, in which the breakage is detected by the comparator 33 and a signal is output to 28, as previously described.

In FIG. 1B, the volume V of a portion within the liquid chamber enclosed by a trailing end face of the liquid channel 12 as indicated by a broken line x within the liquid chamber 14 and a central face (vertical face) of the heat generating element 15 as indicated by a broken line x' is preferably set to be 1 mm≦V≦100 mm. The reason is that with V being equal to or more than 1 mm, a little ink remains in the liquid channel 12 after no ink is detected, and abrupt termination of recording can be avoided, while with V being equal to or less than 100 mm, a little ink remains in the recording head after no ink is detected, and thus the amount of waste ink that is not used can be reduced.

Since the heat generating element will be broken with an occurrence of the ink exhaustion as above described, the heat generating element serves as a storage medium for storing the occurrence of the ink exhaustion, and the arrival of the life span for a recording head in the disposable type, as the breakage of heat generating element. That is, even if a recording head cartridge which exhausted ink is mounted onto another recording apparatus by mistake, misuse and abrupt termination of recording can be prevented as ink detection means can read the information about the ink exhaustion and the arrival of the life span stored in the above-mentioned storage medium.

In this example, the reason for using Al as the heat generating element within the liquid chamber is that first, as Al is used for the wirings of the discharge energy generating elements 13, the heat generating element within the liquid chamber can be formed simultaneously in forming the same Al layer, thereby simplifying the manufacturing process, secondly, Al itself has the resistance value remarkably varying with the temperature. In order to carry out the present invention appropriately, a low melting point material, for example, is used as the heat generating element within the liquid chamber.

Though the holdback type current limiting circuit was used in this example as shown in FIG. 2, there is another way in which a sufficiently higher resistance than that of the heat generating element within the liquid chamber is connected in series therewith to supply the pulsed electric power. In this case, if the resistance value of the above-mentioned heat generating element is increased due to the high resistance connection, the electric power that is consumed with the same resistance will increase almost proportionally, the same resistor can be caused to be broken when there is no recording liquid.

For the heat generating element within the liquid chamber, the same effect can be obtained, for example, at a constant voltage when using a material such as polycrystalline silicone which has a reduced resistance with the rise in temperature, or if the electric power pulses are supplied by using a circuit in which the voltage increases with the decreasing load resistance. Such circuit can be easily created. An example is shown in FIG. 4.

Figure 4:
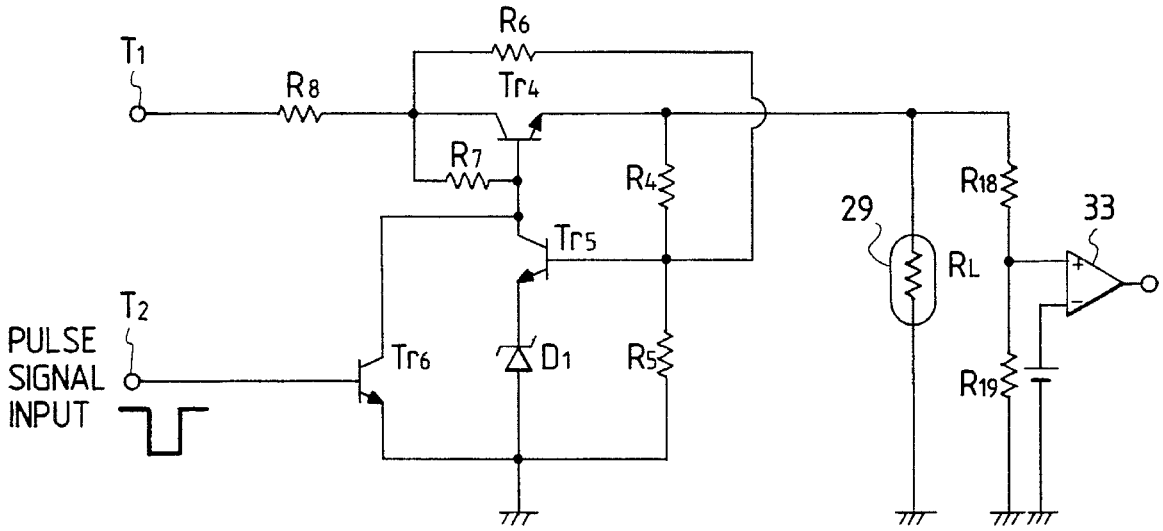

In the detection circuit as shown in FIG. 4, a well known feedback stabilized constant-voltage circuit is incorporated. In the same figure, R18 and R19 are potential divided resistors for the voltage detection, in which those connected in series are connected parallel to the heat generating element 29.

The potential at a junction between the resistors R18 and R19 increases as the heat generating element 29 has the decreased resistance with the rise in temperature, in which the potential is compared with the reference potential by the comparator 33.

Since the same polycrystalline silicone has a high heat resistance, it is difficult to be broken itself, but if a low melting point material such as Al or the like is used as an electrode abutting the heating portion, the heat generating element will be broken owing to the breakage of the electrode.

Accordingly, after the potential at a junction between the resistors R18 and R19 as previously described increases with the rise in temperature of the heat generating element 29, it instantly drops due to a breakage of the electrode as previously described and is equal to or less than the reference voltage, the comparator 33 detects the breakage and outputs a signal.

The operation principle of the detection circuit as shown in FIG. 4 will be described.

First, if the resistance value of RL29 which is a heat generating element decreases with the rise in temperature of the resistor RL29, the current passing through RL increases. Along with it, the voltage drop with the resistor R6 increases and the base current of the transistor $Tr_5$ decreases. Here, as the emitter potential of the transistor $Tr_5$ is kept constant due to a Zener diode $D_1$, the base-emitter voltage decreases and the collector current of the transistor $Tr_5$ decreases.

Thereby, the current passing through the resistor R7 decreases and the voltage drop with the resistor R7 decreases, causing the base potential of the transistor $Tr_4$ to rise. Therefore, the base-emitter voltage of the transistor $Tr_4$ increases and the collector-emitter resistance decreases, thereby causing the potential at the junction between the resistors R18 and R19 to rise. Thereafter, the potential at the junction as previously indicated drops instantly, due to the breakage of a portion of the electrode abutting the heat generating element 29, and the comparator can detect the breakage, as previously described.

EXAMPLE 2

Figure 5:
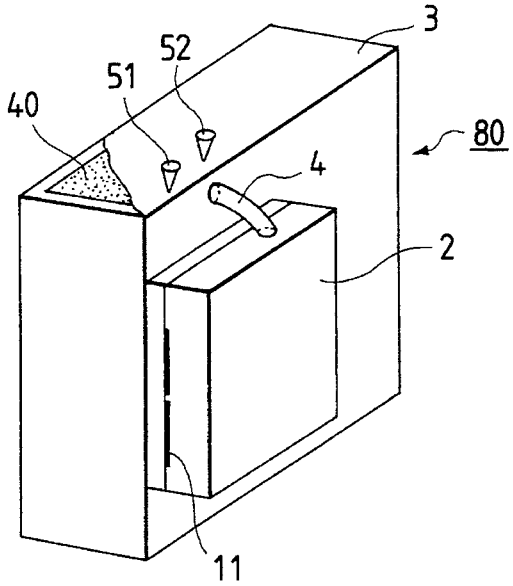
FIG. 5 is a typical perspective view of recording head for explaining the second example.

FIG. 5 is a typical perspective view of a recording head for explaining the second example of the present invention.

In this example, remain detecting means 51, 52 for the recording liquid is provided within the recording liquid storage container, in addition to a resistor within the liquid chamber as described in Example 1.

In this example, the above-mentioned detecting means uses the resistor within the above-mentioned liquid chamber, after detecting the exhaustion of the recording liquid.

The recording head of this example has the recording head stored within the container in the form of being contained in a sponge-like absorbing member 40. The detection of recording liquid remaining within the storage container relies on the detection of the rise in the electrical resistance value between two stainless needles 51, 52 inserted into the absorbing member. Except for this point, the structure of the head is quite the same as that in Example 1.

FIG. 6 is a flowchart for the recording liquid remain detection with the recording head in this example. That is, for each record for one recording sheet, the remain detecting means within the above-mentioned storage container is activated. Thus, after a little remaining recording liquid is detected, pulse electric power is applied to the heat generating element for each print for one line. Then if the same heat generating element broke, the recording is terminated.

Figure 6A:
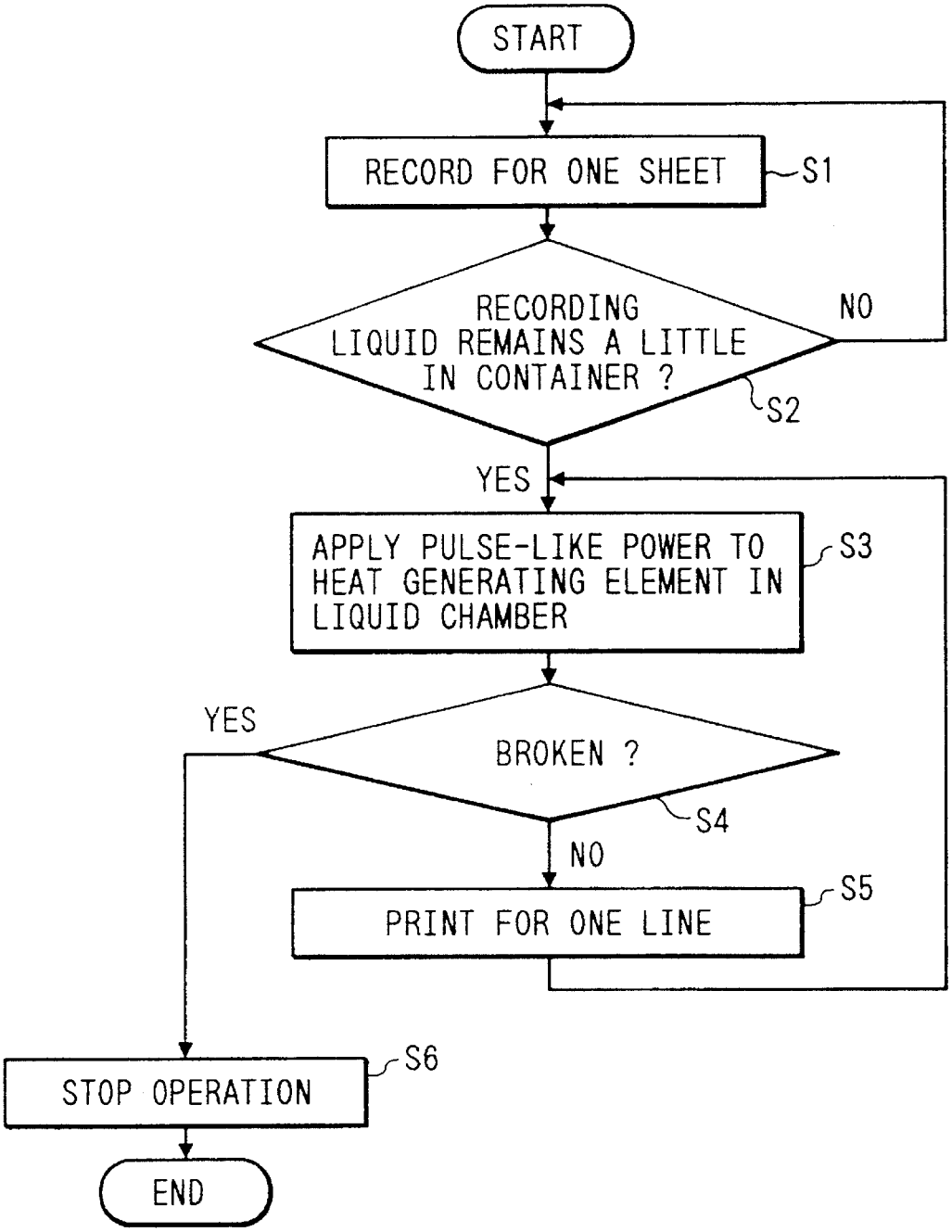
FIG. 6A is a flowchart for detecting recording liquid remaining in the second example.
Figure 6B:
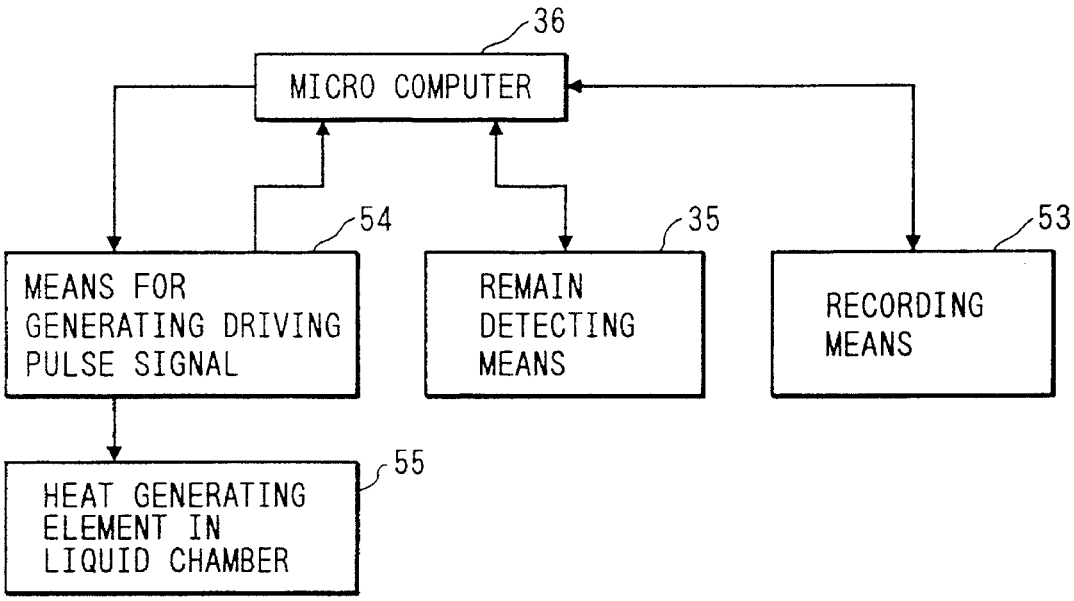
FIG. 6B is a block diagram for showing control means in FIG. 6A.

FIG. 6A is a flowchart for the recording liquid remain detection with the recording head in this example, and FIG. 6B is a block diagram showing means for performing the control as indicated in the above flowchart. Note that in FIG. 6B, 36 is a microcomuter consisting of CPU for controlling each section with control means as will be described later, and one-chip microcomputer containing ROM for storing program corresponding to the control procedure as shown in FIG. 6A, and RAM used for a work area during execution of the control procedure.

First, the recording is performed for one sheet with recording means 53 constructed of the recording apparatus as illustrated in FIGS. 8 and 9 (step S1).

Next, whether or not a little recording liquid remains in the container is detected by activating the remain detecting means within the storage container as previously described (step S2). If a little recording liquid remains in the container, the microcomputer 36 drives driving pulse signal generating means 54 to apply the pulsed electric power to the heat generating element 55 within the liquid chamber (step S3).

Next, the microcomputer 36 determines whether or not the same heat generating element 55 has broken (step S4), and if broken, it displays its indication and terminates the recording operation (step S6) .

Note that the application of the driving pulse electric power until the breakage is made for each print for one line (step S5).

In this example, approximately 15000 characters of record could be effected since the detection of a little recording liquid remaining in the container until the breakage of the heat generating element within the liquid chamber. In this way, a more effective use of recording liquid is enabled by combining remain detecting means in the container with the heat generating element within the liquid chamber.

On the other hand, if the final detection of remaining recording liquid is effected by using the heat generating element within the liquid chamber after recording liquid is exhausted within the storage container, the possibility of false remain detection which may accidentally occur when recording liquid is filled in the liquid chamber but bubbles are present in the vicinity of the heat generating element within the liquid chamber. In this case, of course, the same resistor will not break as long as recording liquid remains within the liquid chamber, and so a more correct detection of recording liquid can be effected.

EXAMPLE 3

Figure 7:
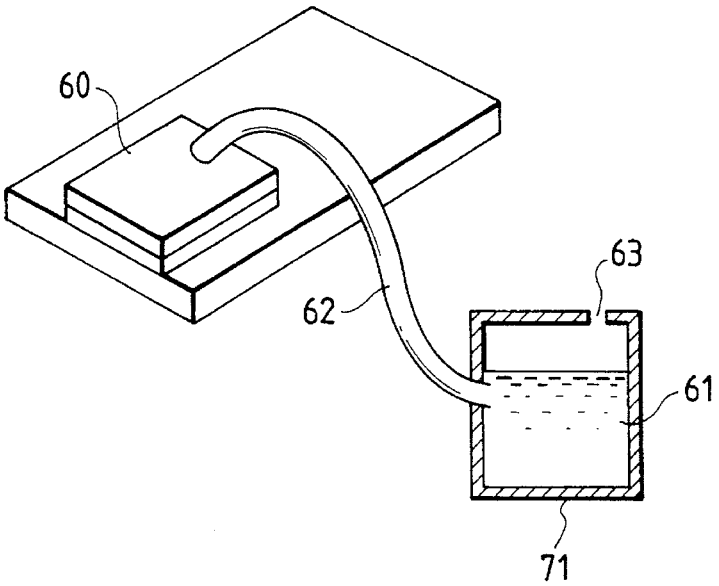
FIG. 7 is a typical perspective view of a recording head for explaining the third example.

FIG. 7 is a typical perspective view for explaining the third example of the present invention.

A recording head 60 in this example, which is a so-called permanent type head, is separated from recording liquid storage container 71 which is mounted on a recording apparatus main body. A liquid chamber of the recording head 60 is communicated via a connection tube 62 to the recording liquid storage container 71. On an upper portion of the recording liquid storage container 71 is punched an atmosphere communicating port 63. Accordingly, if the recording liquid 61 is exhausted, the storage container is only replaced. In such a type of recording head, it is also meaningful to expend the recording liquid until there is no recording liquid within the liquid chamber, in order to prevent the recording liquid from being discarded uselessly. However, as the resistor within the liquid chamber is broken each time no remaining ink is detected, a multiplicity of resistors are provided in this example.

For example, when the life span of a discharge heat energy generating element in the main body of the recording head is on the average as much as approximately 25 million characters of print, and the recording liquid enabling as much as approximately 2.5 million characters of record is contained in one recording liquid storage container, the recording liquid stored in at least 10 recording liquid storage containers can be utilized. In practice, as the life spans vary or the recording liquid is consumed with the recovery operation, the recording head in this example has placed 15 recording liquid detecting resistors within the liquid chamber. If the same resistor has detected no remaining ink and is broken, the next time one of the other resistors is used for the detection. It is possible to cause the main device of the recording apparatus to perform this control.

This result revealed that the detection method of recording liquid according to the present invention can be quite effectively applicable to not only the disposable type but also the permanent type head.

Figure 10A:
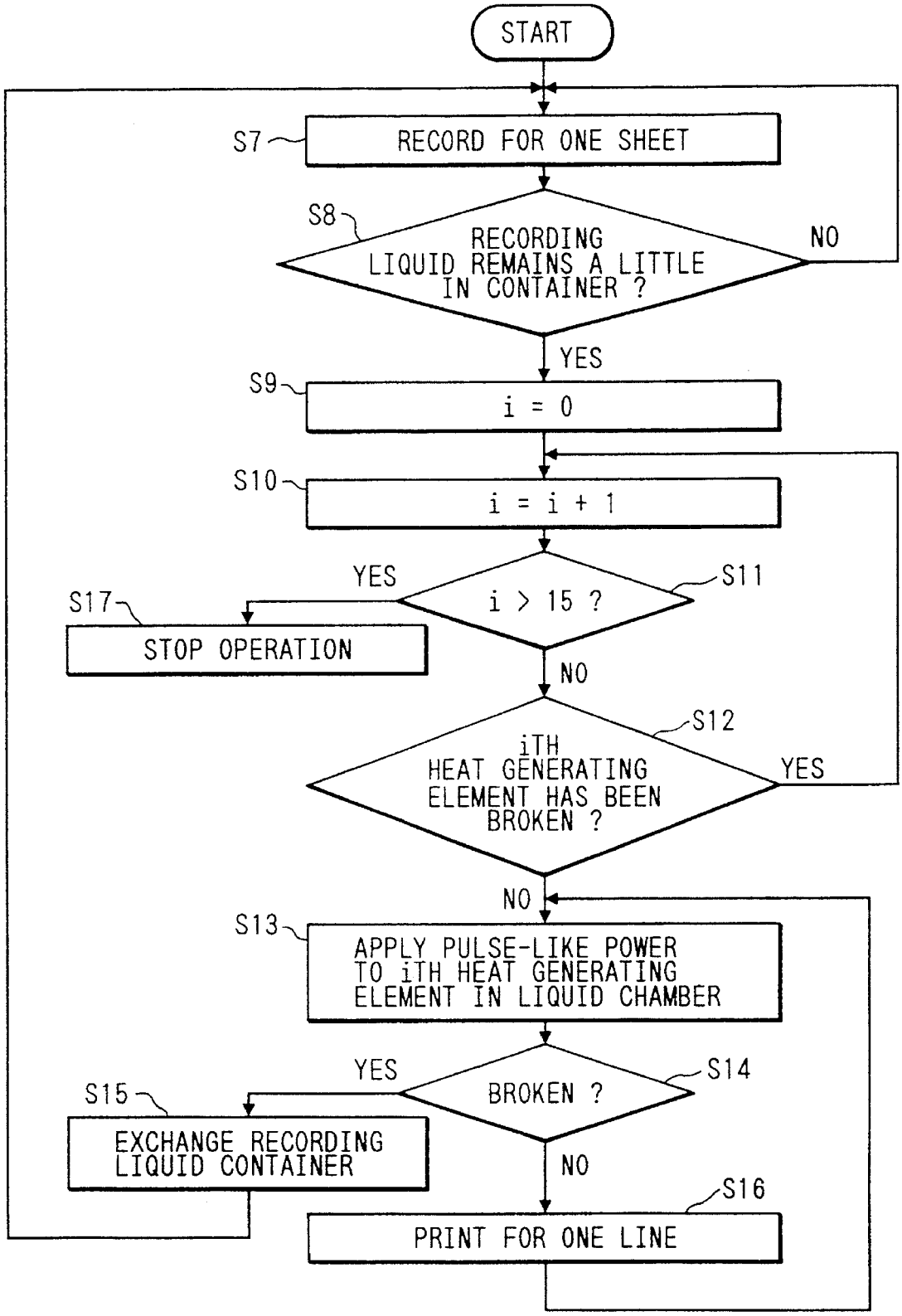
FIG. 10A is a flowchart for showing the control in the third example.

FIG. 10A shows a flowchart for the control as above described.

Figure 10B:
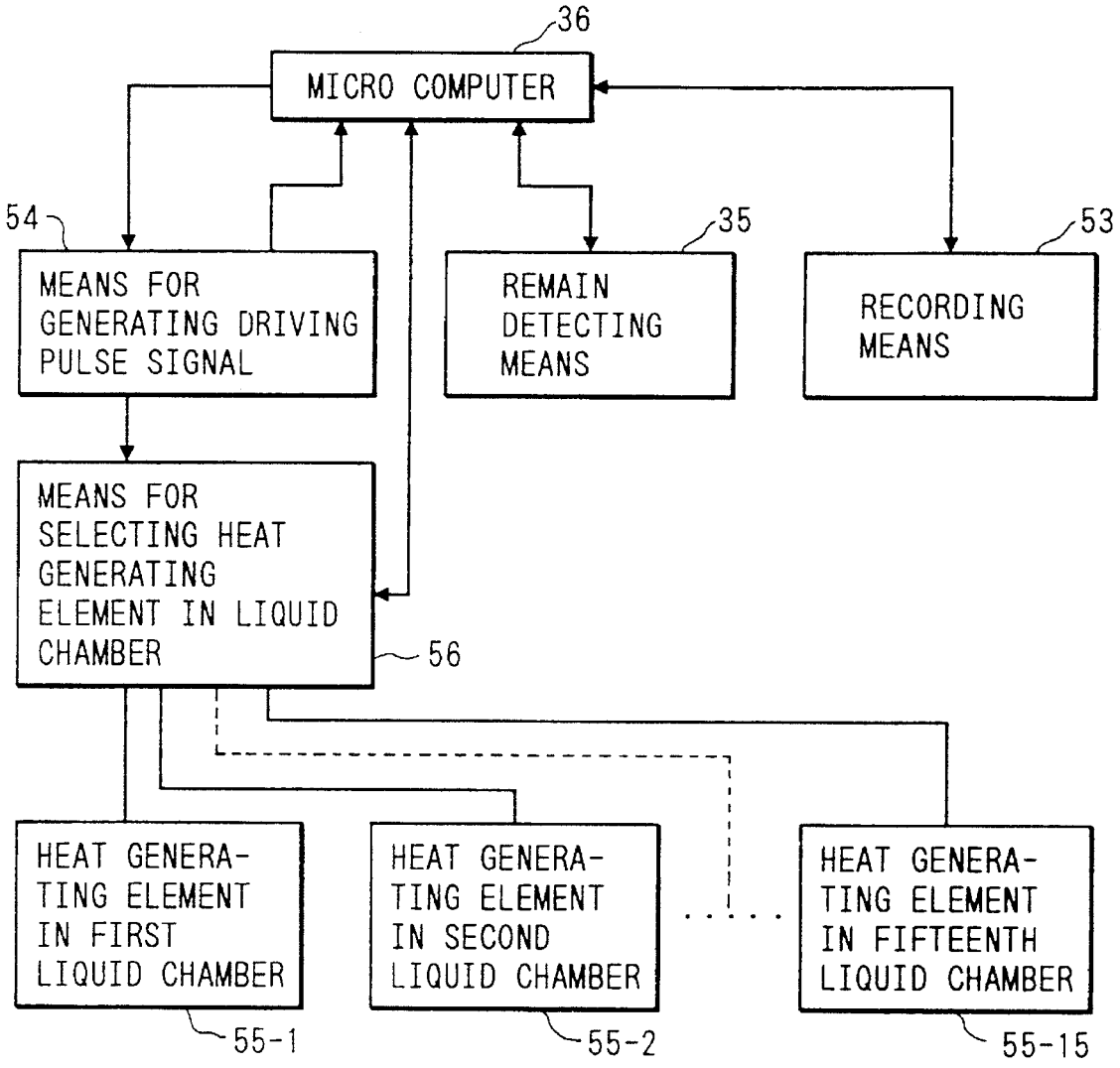
FIG. 10B is a block diagram for showing control means in FIG. 10A.

FIG. 10B is a block diagram showing means for performing the control as shown in the flowchart of FIG. 10A.

First, the recording is effected for one recording sheet with recording means 53 (step S7).

Next, whether or not a little recording liquid remains in the container is detected by activating the remain detecting means in the storage container (step S8). If recording liquid remains a little in container, the microcomputer 36 resets a counter for use in counting the number of heating elements within the liquid chamber (step S9), and increments the counter by one (step S10). Next, whether or not the counter is above 15 is determined (step S11), and if it is 15 or less, whether or not the i-th heat generating element has been broken is determined (step S12). If it is broken, the processing returns to step S10. On the other hand, if it is not broken, the pulse-like power is applied to the i-th heat generating element in the liquid chamber by driving means for generating driving pulse signal 54 and means for selecting heat generating element in liquid chamber 56 (step S13).

Next, the microcomputer 36 determines whether or not the same heat generating element has been broken (step S14), and if broken, the indication of requiring the exchange of recording liquid container is displayed (step S15). If recording liquid container has been exchanged, the processing returns to step S7 again. On the other hand, if it is determined at step S11 that the counter i is above 15, the indication of that effect is displayed and the operation is stopped (step S17). The application of driving pulse power until the breakage of heat generating element is performed for each print of one line (step S16).

It is of course possible to combine this example with the previous example so as to allow the use of a resistor within the liquid chamber after remain detecting means in the storage container detects that a little recording liquid remains.

The recording apparatus requiring the especially high reliability can be configured so that the number of resistors for detecting recording liquid in this example is reduced, and all the resistors for detecting recording liquid are used up before the life span of the recording head. Thereby, if the recording head was used almost over the life span, no usable resistors for detecting recording liquid exist and so the recording head must be exchanged, so that faulty recording due to the life span of the recording head expiring during recording can be prevented.

For the same purpose, the display of the use condition of a recording head is also effective, based on the number of resistors that were broken in the recording apparatus.

EXAMPLE 4

In this example, the heat generating element is not broken when no remaining ink is detected, and comparing the applied voltage to the heat generating element with the reference voltage by means of a comparator, when the applied voltage reaches to a fixed value, the comparator outputs a detection signal of no ink.

The heat generating element 20 made of Al is planar U-shaped, having a width of 3 μm and a total length of 1200 μm, and as the sheet resistance value of a sheet-like Al resistor with the ratio of width to total length being 1:1, is about 0.054 Ω at the normal temperature and about 0.10 Ω at 200° C., the resistance value of the heat generating element 20 is about 22 Ω at the normal temperature and about 40 Ω at 200° C., linearly changing within this temperature range.

Figure 11:
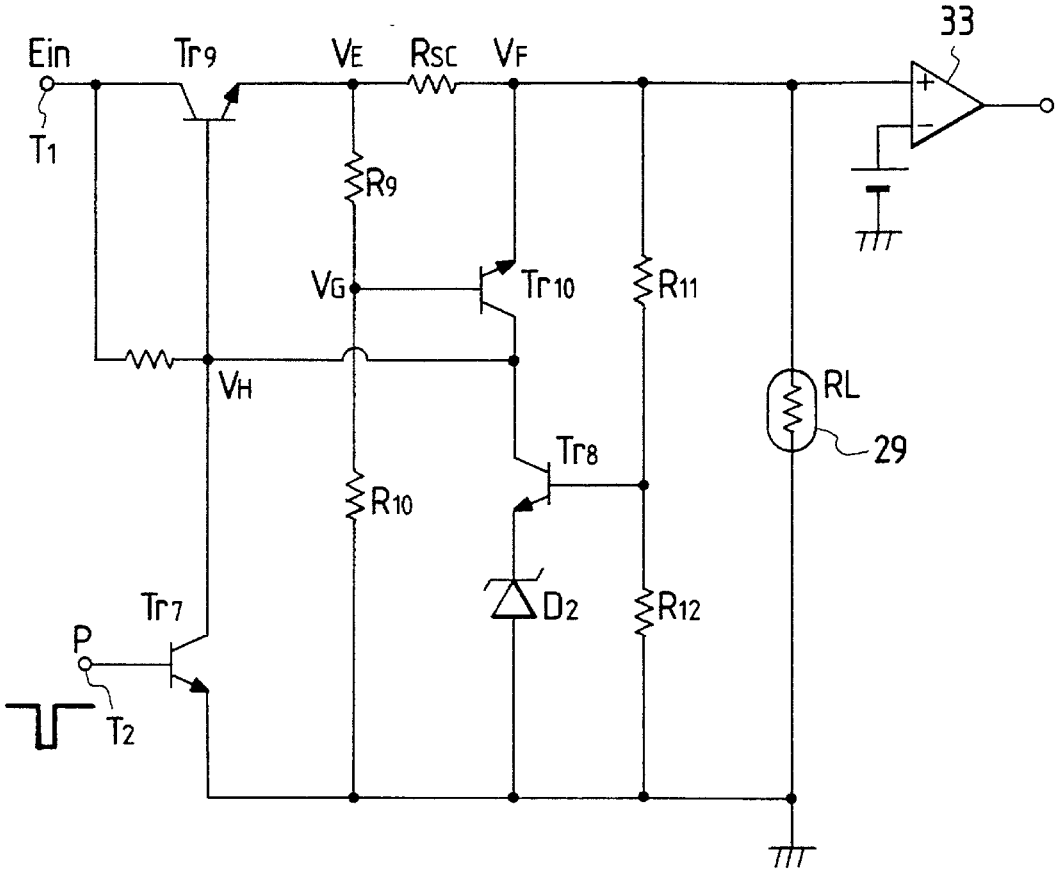
FIG. 11 is a circuit diagram for detecting the electrical resistance to which heating elements are connected in the fourth example.
Figure 12:
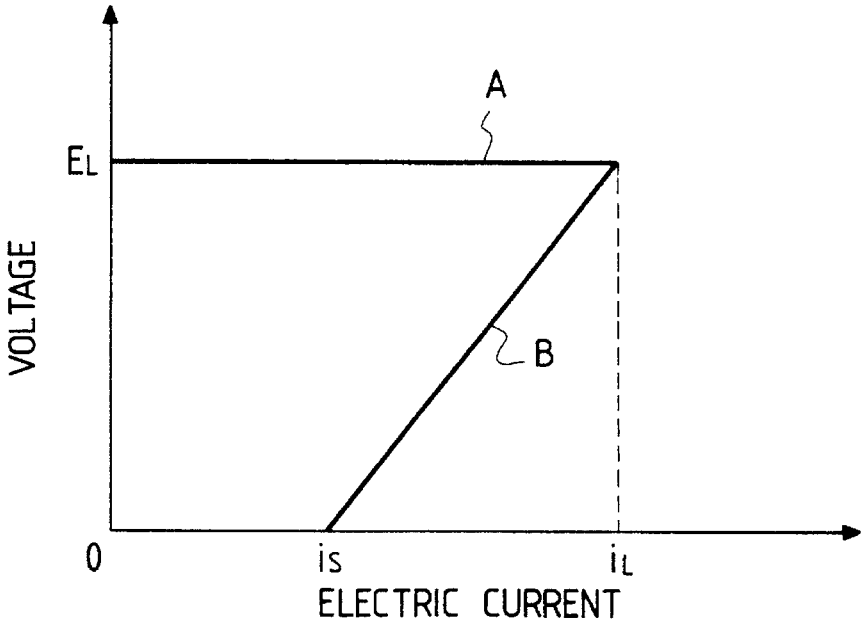
FIG. 12 is a V-I characteristic graph representation for a current limiting circuit in the fourth example.

The heat generating element 29 is connected to an electrical resistance detection circuit of FIG. 11 which is formed integrally with the recording head 1, for example. In the same way as the previous example, a holdback type current limiting circuit is incorporated into the detection circuit. The current limiting circuit has its power supply terminal T1 to which the direct current voltage $E_{in}$ is supplied from the constant voltage source, with the heat generating element 29 as a load resistor, and acts to restrict the load current under a fixed condition, operating when additionally connected transistor $Tr_1$ is "OFF". FIG. 12 is a V-I characteristic representation, indicating the negative characteristic of rapidly decreasing the applied voltage to load which has been maintained at a constant voltage ($E_L$) if the load current exceeds a predetermined value ($i_L$).

That is, if the load current is equal to or less than $i_L$, i.e., the electrical resistance of the heat generating element 29 exceeds ($E_L/i_L$), the constant voltage characteristic is exhibited as shown by a line A in FIG. 12, in which the Zener voltage (reference voltage) of a Zener diode $D_2$ and the divided voltage of output voltage with resistors R11 and R12 are compared, and differential current between them is taken out from transistor $Tr_8$ to drive transistor $Tr_9$. On the other hand, if the load current exceeds $i_L$, i.e., the electrical resistor of the heat generating element 29 is less than ($E_L/i_L$), the current limiting characteristic is exhibited as shown by a line B in FIG. 12, in which transistor $Tr_{10}$, which is connected to divider resistors R9 and R10 for detecting the applied voltage and a resistor $R_{SC}$ for detecting the current, operates, and short-circuits the base-emitter for transistor $Tr_9$.

In FIG. 12 $E_L$, $i_s$, and $i_L$ are given by the following formulas.

$$E_m=E_{in}-V_{BE}$$

$$E_L=E_m-i_L R_{SC}$$

$$i_s=(V_{BE}/R_{SC})\ (R9+R10)$$

$$i_L=V_{BE}/R_{SC}+\{R9/(R9+R10)\}E_m/R_{SC}$$

Where E is a voltage at $V_E$ when $R_C$ has no load, $E_L$ is a voltage at $V_F$ when the maximum current $i_L$ passes through $R_L$, is a current passing through $R_L$ when the resistance of $R_L$ is assumed to be zero, and each resistance value of R3 and R4 is sufficiently larger than that of the heat generating element 29. $E_i$ is a constant voltage applied to the power supply terminal $T_1$, and $V_{BE}$ is a potential difference between base and emitter of transistor, about 0.6 volts.

Consequently, if the electrical resistance of the heat generating element 29 is less than ($E_L/i_L$), the applied voltage to the heat generating element 29 is an increasing function of the resistance value of the heat generating element 29, while if the electrical resistance becomes equal to or more than ($E_L/i_L$) with the rise in temperature of the heat generating element 29, the applied voltage is maintained at a constant value ($E_L$ ).

The applied voltage to the heat generating element 29 is compared with the reference voltage by means of a comparator 22, and when the applied voltage reaches a fixed value ($E_L$ ), the comparator 33 outputs a detection signal of no ink.

Next, the action will be described.

A discharge energy generating element 13 within each liquid channel 12 generates the heat energy with the electric power being supplied selectively depending on record data, which causes the film boiling in the ink within the liquid channel 12, thereby discharging the ink through discharge ports 11 along with the growth of bubbles owing to the film boiling. In this way, various information are recorded by moving the carriage 16 while selectively discharging the ink through a plurality of discharge ports 11, and sticking ink droplets onto recording medium 5. In this example, as shown in FIG. 9, ink droplets of yellow, magenta, cyanogen and black are stuck consecutively onto recording medium 5 from four recording heads 1A, 1B, 1C and 1D, so that color image can be printed.

If transistor $Tr_1$ is caused to turn "OFF" by supplying a driving pulse signal P to the driving terminal $T_2$ of the transistor $T_1$, the voltage is applied to the heat generating element 29, which will then generate the heat.

If the ink exists on the heat generating element 29 when generating the heat, i.e., there is some ink supplied to a common liquid chamber 14, the heat generated from the heat generating element 29 is radiated to the ink, thereby suppressing the rise in temperature of the heat generating element 29 itself. Accordingly, the heat generating element 29 in this case has a smaller electrical resistance than that in a case of the temperature rise as will be described later, its electrical resistance being set to be less than ($E_L/i_L$). Therefore, the applied voltage to the heat generating element 20 is an increasing function of the resistance in the heat generating element 29, with an upper limit of a fixed value ($E_L$). Accordingly, the comparator 33 does not output any detection signal of no ink.

On the other hand, when the heat generating element 29 generates the heat, the temperature of the heat generating element 29 itself will rapidly rise if there is no ink on the heat generating element 29, i.e., there is no ink left in the common liquid chamber 14. This is because the heat is radiated to the air or water vapor, which has a lower heat conductivity and so a smaller degree of heat radiation than the ink. Thus the electrical resistance of the heat generating element 29 rapidly increases. The electrical resistance at this time is set to exceed ($E_L/i_L$). Accordingly, the applied voltage to the heat generating element 29 reaches to a fixed value ($E_L$), and the comparator 33 outputs a detection signal of no ink.

And the control circuit provided on the main body of apparatus can detect whether or not there is any ink remaining based on an output from the comparator 33. At the time when the detection signal of no ink is output, any abrupt stop of recording never occurs because a small amount of ink remains in the liquid channel 12. Therefore, it is possible to cope with by detecting the time immediately before the ink is completely exhausted, thereby enabling a total amount of ink to be used.

Such operation could be confirmed with the following specific example of experiment. Condition for the experiment Heat generating element 29:

As previously described, Al resistor is U-shaped, having a resistance of about 22 Ω at the normal temperature and about 40 Ω at 200° C., the resistance value changing linearly within that temperature range.

$E_{in}$:20 V (same as the applied voltage to discharge energy generating element 13)

$E_m$: 19.4 V $R_{SC}$: 4.7 Ω

R1: 330 Ω

R2: 3.3 k Ω

Pulse width of a pulse signal to be supplied to the driving terminal $T_2$: 7 μsec Results from the experiment When no ink exists on the heat generating element 29.

When a single driving pulse signal P was supplied to the driving terminal $T_2$, the potential difference on the heat generating element 29 instantly reached $E_L$, and the comparator output a detection signal of no ink. In accordance with the calculation of heat conduction, it is expected that the temperature of the heat generating element 29 will become approximately 200° C. in 5 μsec after application of a driving pulse signal P.

Note that 106 driving pulse signals were supplied to the driving terminal $T_2$, but the heat generating element 29 was not broken.

When the ink exists on the heat generating element 29.

When one pulse of the driving pulse signal P was supplied to the driving terminal $T_2$, the temperature of the heat generating element 29 reached about 80° C. at maximum, with the potential difference on the heat generating element 29 being about half that of $E_m$, and the comparator did not output the detection signal of no ink.

By the way, the timing at which a driving pulse signal P is supplied to the driving terminal $T_2$, i.e., the heat generating element 29 is caused to generate the heat, is determined to have appropriate intervals depending on the size of common liquid chamber 14. For example, the timing at which the recording head 1 prints for one line can be adopted. If bubbles within the recording head 1 were removed by means of the recovery pump, the driving pulse signal P is preferably supplied immediately after that removal.

Figure 13:
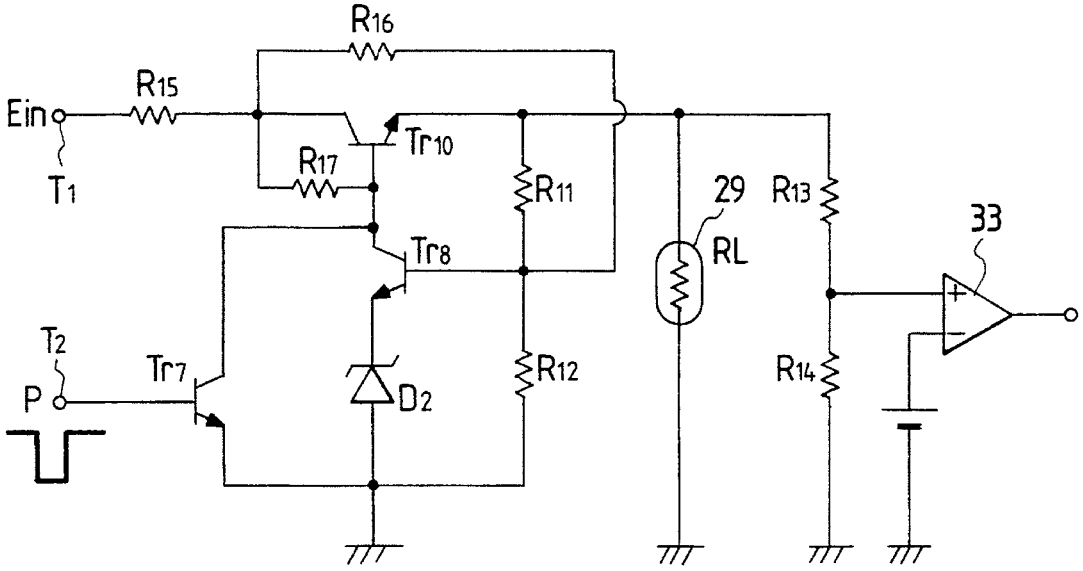
FIG. 13 is a circuit diagram for detecting the electrical resistance to which heating elements are connected, when heating elements are made of a material having a smaller resistance with the rise in temperature.

For the heat generating element, a material such as polycrystalline silicon which has a reduced resistance with the rise in temperature can be used. In this case, the heat generating element 29 is connected to, for example, the detection circuit of the electrical resistance as shown in FIG. 13. In this detection circuit, a well known feedback stabilized constant-voltage circuit is incorporated, wherein like reference numerals are affixed to parts with the same functions as those of the circuit components in FIG. 11 as previously described. In the same figure, R5 and R6 are potential divided resistors for the voltage detection, in which those connected in series are connected parallel to the heat generating element 29. The potential at a junction between the resistors R5 and R6 increases as the heat generating element 29 has the decreased resistance with the rise in temperature of the heat generating element 29, in which that potential is compared with the reference potential by the comparator 33. Accordingly, in the same way as in the previously described example, the detection signal of no ink can be output from the comparator 33. The operation principle of the detection circuit as shown in FIG. 13 will be described briefly.

First, if the resistance value of RL29 which is a heat generating element decreases with the rise in temperature of the resistor RL29, the current passing through $R_L$ increases. Along with it, the voltage drop with the resistor R16 increases and the base potential of the transistor $Tr_8$ decreases. Here, as the emitter potential of the transistor $Tr_8$ is kept constant due to a Zener diode $D_1$, the base-emitter voltage decreases and the collector current of the transistor $Tr_8$ also decreases.

Thereby, the current passing through the resistor R17 decreases and the voltage drop with the resistor R17 decreases, causing the base potential of the transistor $Tr_{10}$ to rise. Therefore, the base-emitter voltage of the transistor $Tr_{10}$ increases and the collector-emitter resistance of the transistor $Tr_{10}$ decreases, thereby causing the potential at the junction between the resistors R13 and R14 to rise.

This potential is compared with the reference potential, and if it becomes equal to or more than the reference potential, a detection signal of no ink is output.

EXAMPLE 5

Figure 14:
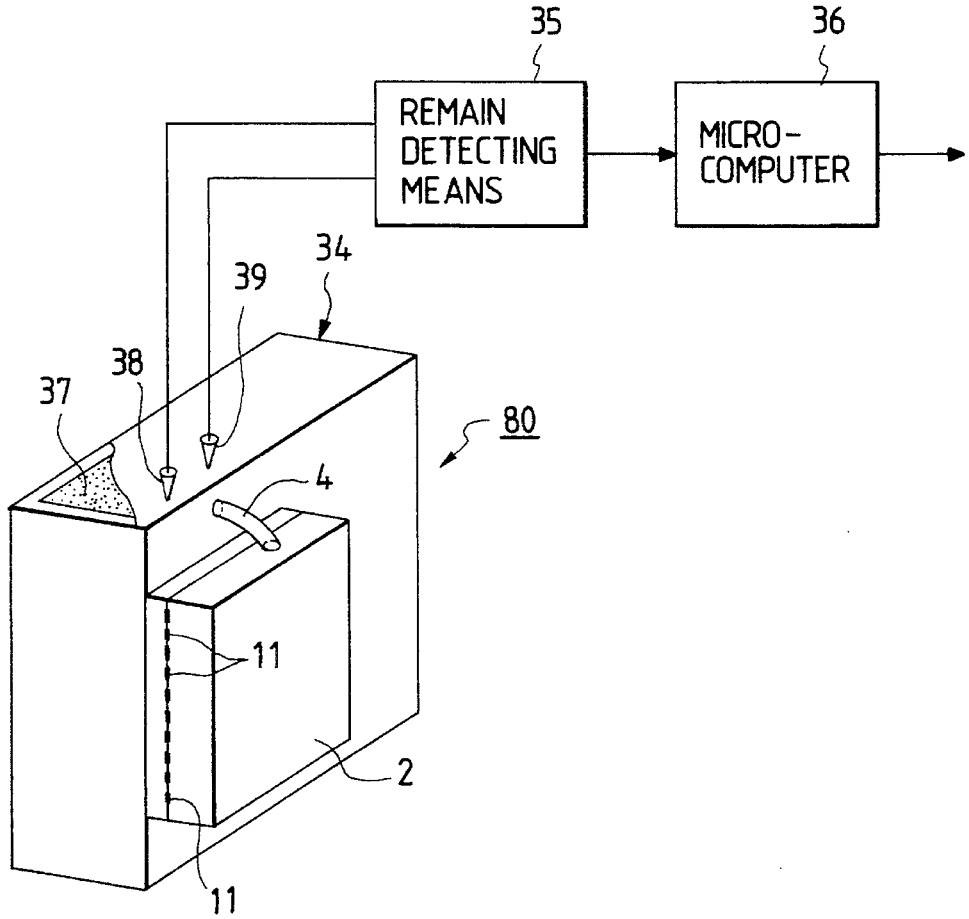
FIG. 14 is a perspective view showing a recording head, partially broken away, in the fifth example.
Figure 15:
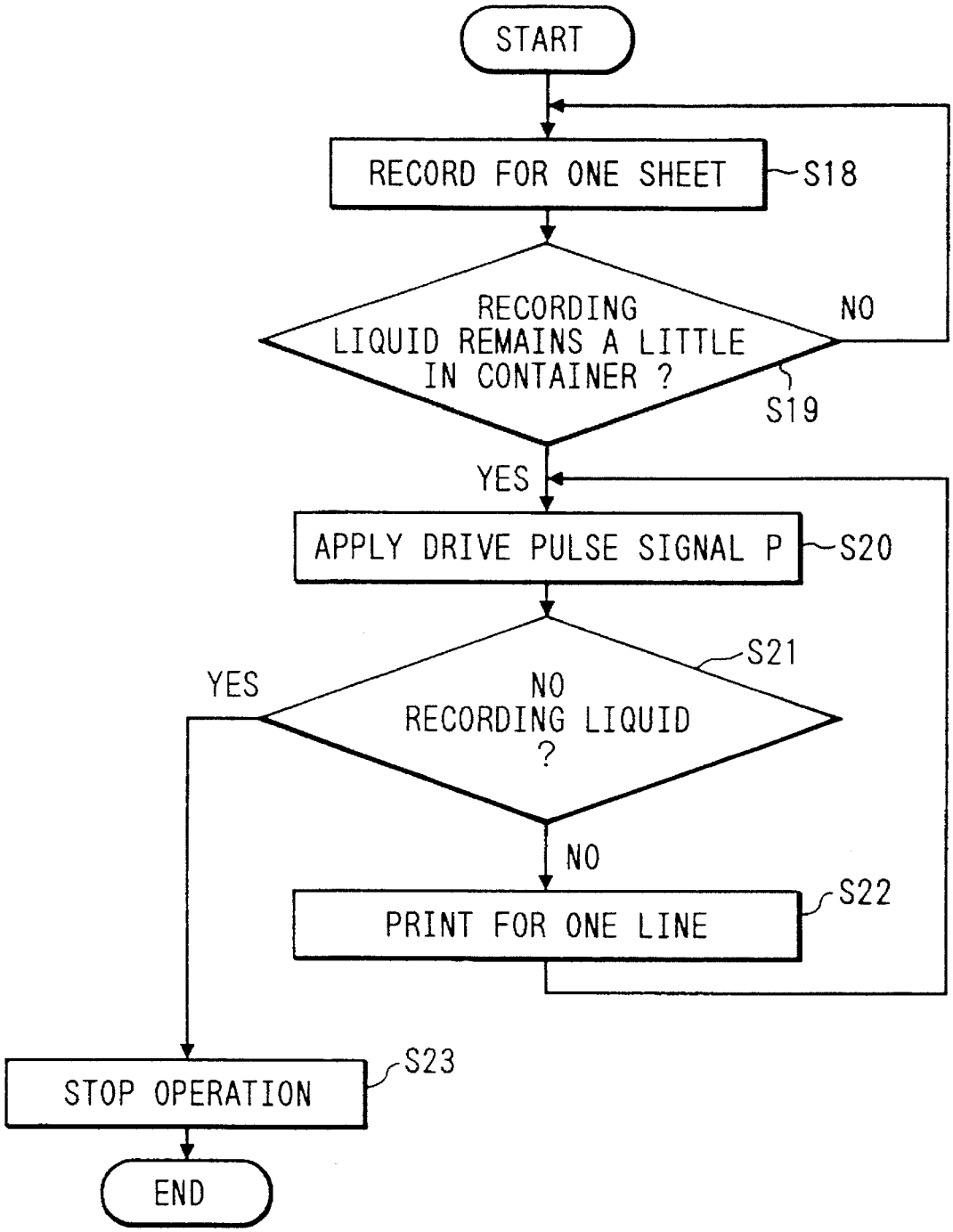
FIG. 15 is a flowchart for explaining the operation in the fifth example.

FIGS. 14 and 15 are views for explaining the fifth example of the present invention.

In this example, remain detecting means 35 for detecting the quantity of ink remaining in the ink storage section 34 and a microcomputer 35 which is control means for the driving pulses are provided, in addition to a constitution as described in Example 4. The remain detecting means 35, using two stainless needless 38 and 39 inserted into the sponge-like absorbing member 37 for absorbing and storing the ink in the ink storage section 34, detects that a little ink remains in the ink storage container 34 when the electrical resistance value between these stainless needles 38 and 39 increases. The microcomputer 36 controls the timing of applying the driving pulse signal P in the forth example as previously described, based on a result of the detection with remain detecting means 35.

The operation in this example will be described with reference to a flowchart of FIG. 15. Note that a block diagram for control means in the flowchart as shown in FIG. 15 is the same as that shown in FIG. 6B.

First, recording is performed for one sheet with recording means 53 (step S18), and then, the microcomputer determines whether or not a little ink remains in the ink storage container 34 by activating the remain detecting means 35 (step S19). If the ink remaining is sufficient, the processing returns to previous step S18. Accordingly, remain detecting means 35 operates each time recording is effected for one recording sheet. If remain detecting means 35 detects that a little ink remains, the processing proceeds to step S20, where the microcomputer 36 drives driving pulse signal generating means 54 to apply the driving pulse signal P to the heat generating element 55 within the liquid chamber, thereby generating the heat. Next, the microcomputer 36 determines whether or not a little ink remains in the common liquid chamber 14 from the output of comparator 33 in the fourth example as previously described (step S21). If the ink remains, the print is effected for one line with the recording head 2 (step S22), and then the processing returns to step S20. Accordingly, thereafter, each time the print is effected for one line, whether or not a little ink remains in the common liquid chamber 14 is detected.

If it is determined at step S21 that no ink remains, i.e., the comparator 33 in the fourth example as previously described outputs a detection signal of no ink, the indication of that effect is displayed and the print operation is stopped (step S23).

In this example, the detection time when remain detecting means 35 detects that a little ink remains could be set at the time, for example, when the print of as much as about 15000 characters is enabled, before all ink is exhausted within the recording head 2 and so the discharge energy generating elements 13 are broken. Accordingly, it is sufficiently in time even if from that detection time, a determination is started whether or not the ink remains in the common liquid chamber 14. If the heat generating element 29 is caused to generate the heat, after remain detecting means 35 detects that a little ink remains, it is advantageous in the following point. That is, though the ink is filled in the common liquid chamber 14, the possibility of false detection in the base where bubbles do not exist in the vicinity of the heat generating element 29, i.e., false detection of no ink, can be reduced.

EXAMPLE 6

Figure 16:
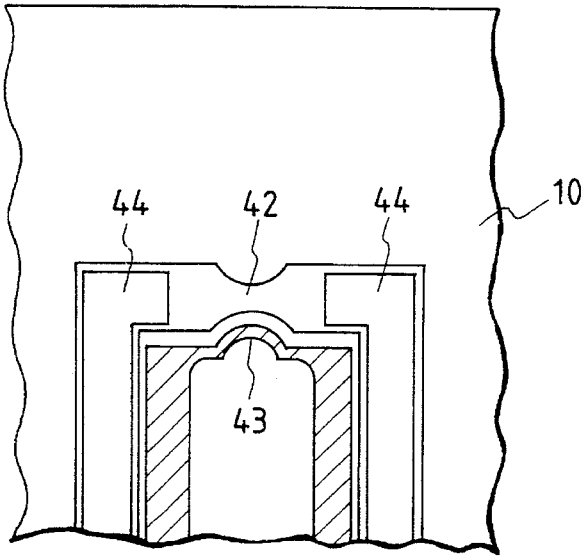
FIG. 16 is a plan view showing a part of a substrate in a head chip in the sixth example.

FIG. 16 is a view for explaining a sixth example of the present invention.

In this example, two functions of the heat generating element 29 in the first example as previously described, i.e., the function as a heat generating element which generates the heat by conduction, and the function as a temperature detecting element having the electrical resistance varying with the temperature, are constituted from separate members. That is, on a substrate 10 made of Si constituting the head chip 2 are formed the heating section 42 of $HfB_2$ layer performing the former function and the temperature detecting section 43 of Al layer performing the latter function. The heating section 42 is connected via a wiring section 44 of Al layer to a circuit for turning on electricity, not shown, while the temperature detecting section 43 is connected via an extension section of Al layer forming a part thereof to a resistance detecting circuit, not shown.

The heat generating section 42 is cut away on both sides to have a smaller width, in which the heat is concentrated on a portion of the small width, to have a larger difference between the temperature when ink exists on the portion of the small width and that when ink does not exist thereon. The heat generation section 42 can be formed by the $HfB_2$ layer which is coated for convenience of the film process on the substrate 10. The temperature detecting section 43 is positioned near the heat generating section 42 as closely as possible. Like the first example as previously described, thermal oxidation film of $SiO_2$ layer is coated between a surface of the substrate 10 and the $HfB_2$ layer formed for convenience of the film process on the substrate 10. The $SiO_2$ layer is thicker, i.e., has a thickness of 10 μm, in order to prevent the heat on the heat generating section 42 from escaping onto the substrate 10.

With such a constitution, the heat generating section 42 is caused to generate the heat by conduction at a predetermined timing by means of the circuit for turning on electricity which is connected to the heat generating section 42, and the resistance value corresponding to the temperature change of the temperature detecting section 43 is detected by the resistance detecting circuit connected to the temperature detecting section 43, so that in the same way as-previously described in the first example, whether or not ink exists on the heat generating section 42 can be detected. Thus, this example is constituted with a combination of the heat generating section 42 made of a material such as $HfB_2$ with its resistance slightly varying with the temperature and the temperature detecting section 43 made of a material such as Al with its resistance greatly varying with the temperature.

It should be noted that this invention is applicable to an ink jet recording apparatus of not only the permanent type but also the disposable type.

As above described, according to the present invention, the recording liquid can be effectively used almost 100%, and the reliability for detecting remaining ink can be improved.

And according to the present invention, it is possible to provide a recording apparatus and method for detecting the recording liquid which can reliably detect that a little recording liquid remains.

Further, according to the present invention, it is possible to provide a recording apparatus and method for detecting the recording liquid which can not only eliminate the waste of recording liquid, but also resolve the problem of spoiling the surroundings due to the leak of recording liquid from a disposed recording liquid storage container.

Still further, according to the present invention, a predetermined exact volume is provided between discharge energy generating elements and the heat generating element, and thus a little ink remains within the liquid channel at the time when a detection signal of no ink is output, so that it is possible to prevent an abrupt stop of recording and enable a high quality of recording.

And according to the present invention, as the heat generating element is not provided in the liquid channel adjacent discharge ports, it is possible to avoid a false detection of ink remaining in a case where the ink is filled within the liquid chamber but bubbles exist in the liquid channel by accident.

The present invention brings about excellent effects particularly in a recording head or a recording device of the ink jet system for recording by forming minute liquid droplets with the heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) though an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333, or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specifications or the constitution as one recording head integrally formed may be used.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc. is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Though the ink is considered as the liquid in the examples of the present invention as described above, other ink is also sufficiently used if it stiffens below the room temperature and softens or liquefies at the room temperature, or liquefies when a recording enable signal is issued as it is commonly practiced in the ink jet system to control the viscosity of ink to be maintained within a certain range for the stable discharging by adjusting the temperature of ink in the range from 30° C. to 70° C.

In addition, the ink which has the property of liquefying only with the application of heat energy is also applicable to the present invention, wherein the ink will liquefy with the heat energy applied in accordance with a record signal so that liquid ink is discharged, thereby stiffening when it has arrived at the recording medium, either by using such ink that allows a part of heat energy to be utilized positively as the energy for the change of state from solid to liquid, to prevent the temperature up, or stiffens in the shelf state to avoid the evaporation of ink. In this case, the ink can be held in recesses or through holes of porous sheet as liquid or solid matter, and opposed to electricity-heat converters, as described in Japanese Laid-Open Patent Applications No. 54-56847 and No. 60-71260. The most effective method for inks as above described in the present invention is one based on the film boiling as above indicated.

Further, a recording apparatus according to the present invention may be used integrally or separately as an image output terminal in the information processing equipment such as computer or word processor, a copying machine in combination with a reader, or a facsimile terminal equipment having the transmission and reception feature.

Figure 17:
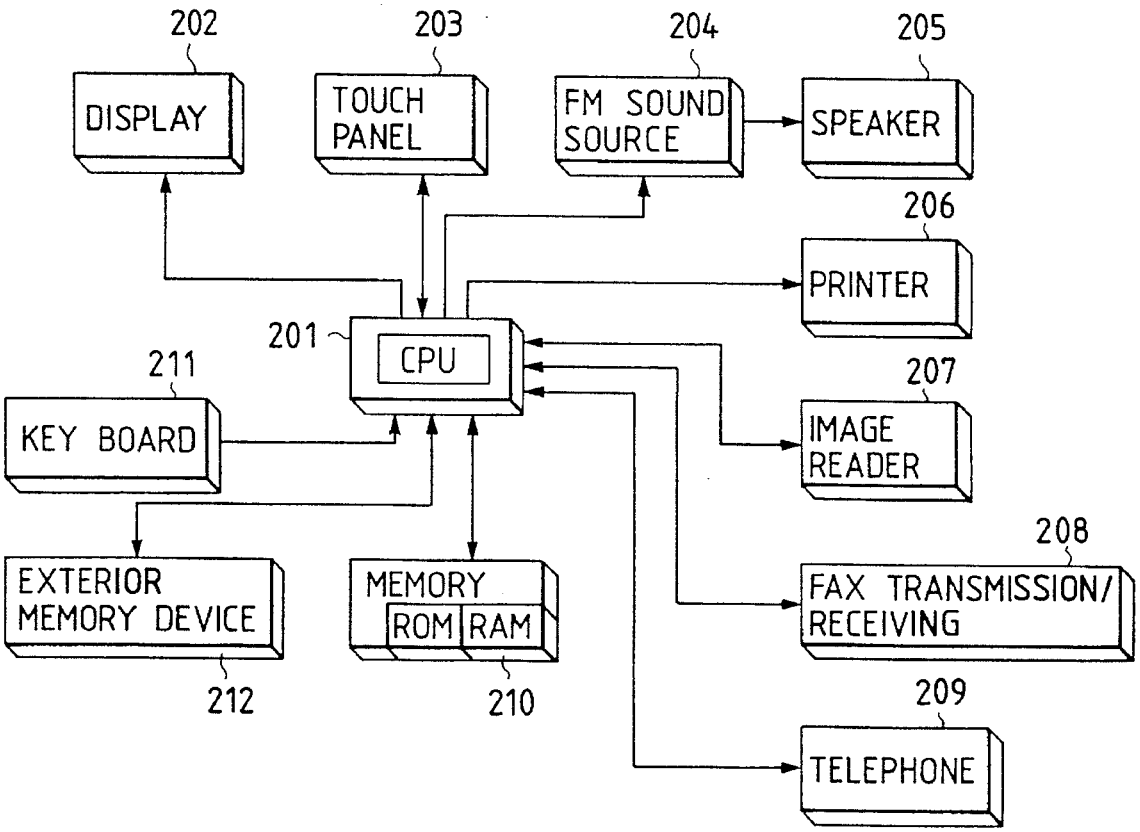
FIG. 17 is a block diagram showing a schematic configuration where a recording apparatus of the present invention is applied to an information processing device.

FIG. 17 is a block diagram showing a schematic configuration in which a recording apparatus of the present invention is applied to the information processing apparatus having the feature of word processor, personal computer, facsimile terminal equipment, and copying machine.

In the figure, 201 is a control unit for controlling the whole apparatus, wherein it comprises CPU such as a microprocessor or various I/O ports, and controls by outputting or inputting control or data signals to or from each section, respectively. 202 is a display section, which displays various menus, document information, and image data read with an image reader 207 on the display screen. 203 is a transparent, pressure sensitive touch panel provided on the display section 202, which enables the entry of items or coordinate values on the display section 202 by depressing its surface with a finger or the like.

204 is a FM (Frequency Modulation) sound source section, which makes the FM modulation for the music information created with the music editor, which is stored in the memory 1810 and the external storage device 1812 as the digital data. An electrical signal from the FM sound source section 204 is converted into an audible sound by a speaker section 205. A printer section 206 is useful as the output terminal for a personal computer, a facsimile terminal equipment, or a copying machine, to which the present invention is applied.

207 is an image reader section which inputs by reading original data photoelectrically, and is provided midway on the conveying path of the original to read facsimile or copying original, and other various types of originals. 208 is a facsimile (FAX) transmission or reception section for transmitting original data read by the image reader section 207 with the facsimile or receiving and decoding facsimile signals that are transmitted, having an interface facility with the outside. 209 is a telephone section, comprising various telephone features, such as ordinary telephone function or automatic answering telephone function.

210 is a memory section comprising a ROM for storing system programs, manager programs and other application programs, character fonts, and dictionary, as well as application programs loaded from the external storage device 212, document information, and a video RAM.

211 is a keyboard section for inputting document information or various commands.

212 is an external storage device, which is a storage medium consisting of the floppy disk or hard disk, is used to store document information, music or audio data, and user's application programs.

Figure 18:
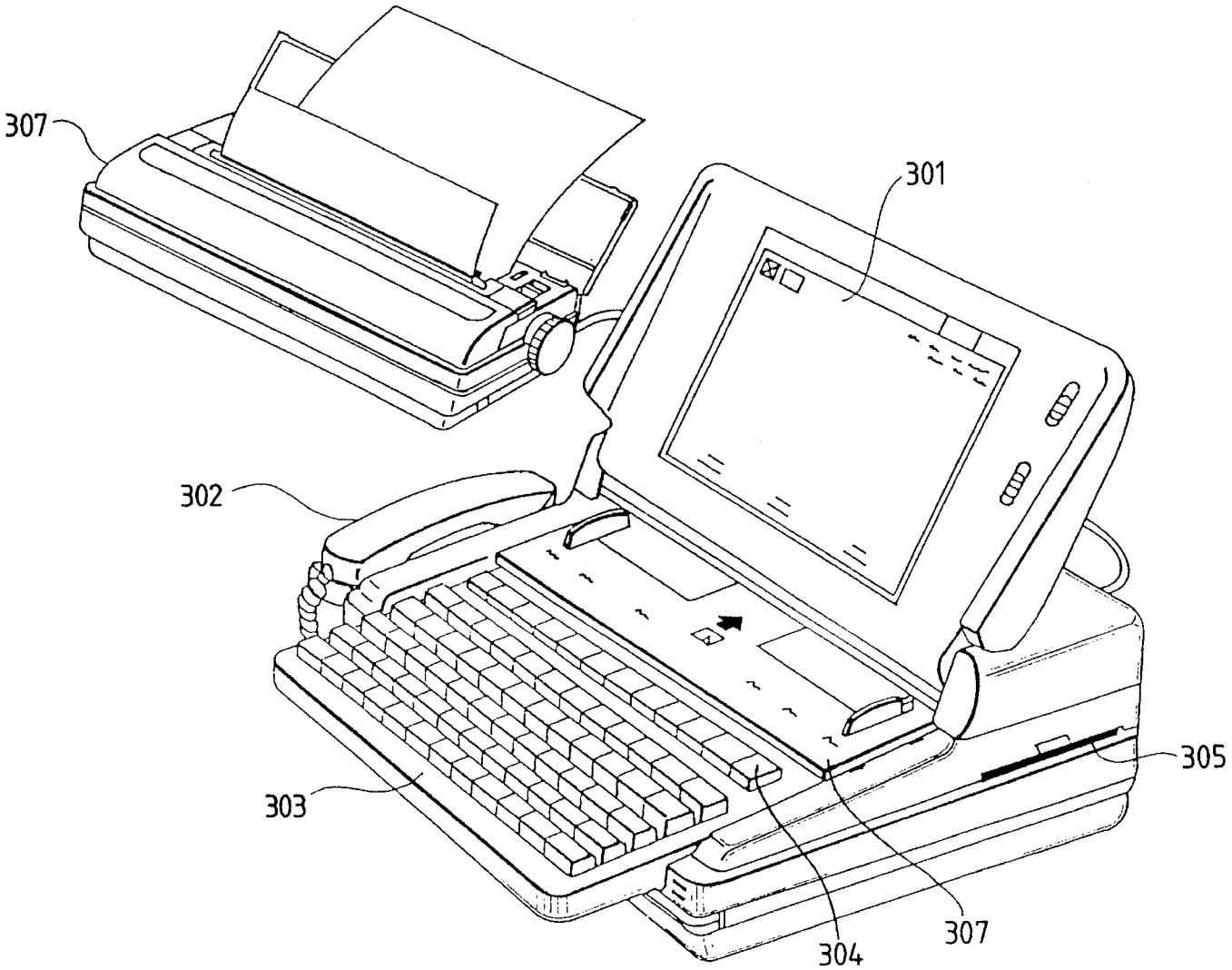
FIG. 18 is an external view of the information processing device as shown in FIG. 17.

FIG. 18 is a typical appearance view of the information processing apparatus as shown in FIG. 17.

In the figure, 301 is a flat panel display, for displaying various menus, graphic data or documents. On this display 301 is installed the touch panel 203, which enables the entry of coordinates or item specifications by depressing a surface of the touch panel 203 with a finger or the like. 302 is a handset to be used when the apparatus functions as a telephone.

The keyboard 303 is detachably connected via a cord to the main body, and is used to input various documents or data. The keyboard 303 is also provided with various types of function keys 304. 305 is an opening for insertion of the floppy disk into the external storage device 212.

307 is a paper stack section for stacking papers to be read by the image reader section 207, in which a read paper is exhausted from the rear portion of device. In the facsimile reception, received data is recorded by the ink jet printer 307.

It should be noted that the display section 202 as above described may be a CRT, but is preferably a flat panel of the liquid crystal display using a ferroelectric liquid crystal. This is because it can be more compact, thinner, and lighter.

When the above mentioned information processing unit functions as a personal computer or word processor, various information input from the keyboard 211 are processed according to a predetermined program in the control section 201, and output to the printer 206 as images.

When it functions as a receiver for the facsimile terminal equipment, the facsimile information input from the FAX transmission and reception section 208 via the transmission line are received and processed according to a predetermined program in the control section 201, and output to the printer section 206 as received images.

And when it functions as a copying machine, an original is read by the image reader section 207, and original data that was read is output via the control section 201 to the printer section 206 as copied image. Note that it functions as a transmitter for the facsimile terminal equipment, original data that was read by the image reader section 207 is processed for transmission according to a predetermined program in the control section 201, and transmitted via the FAX transmission and reception section 208 to the transmission line.

Figure 19:
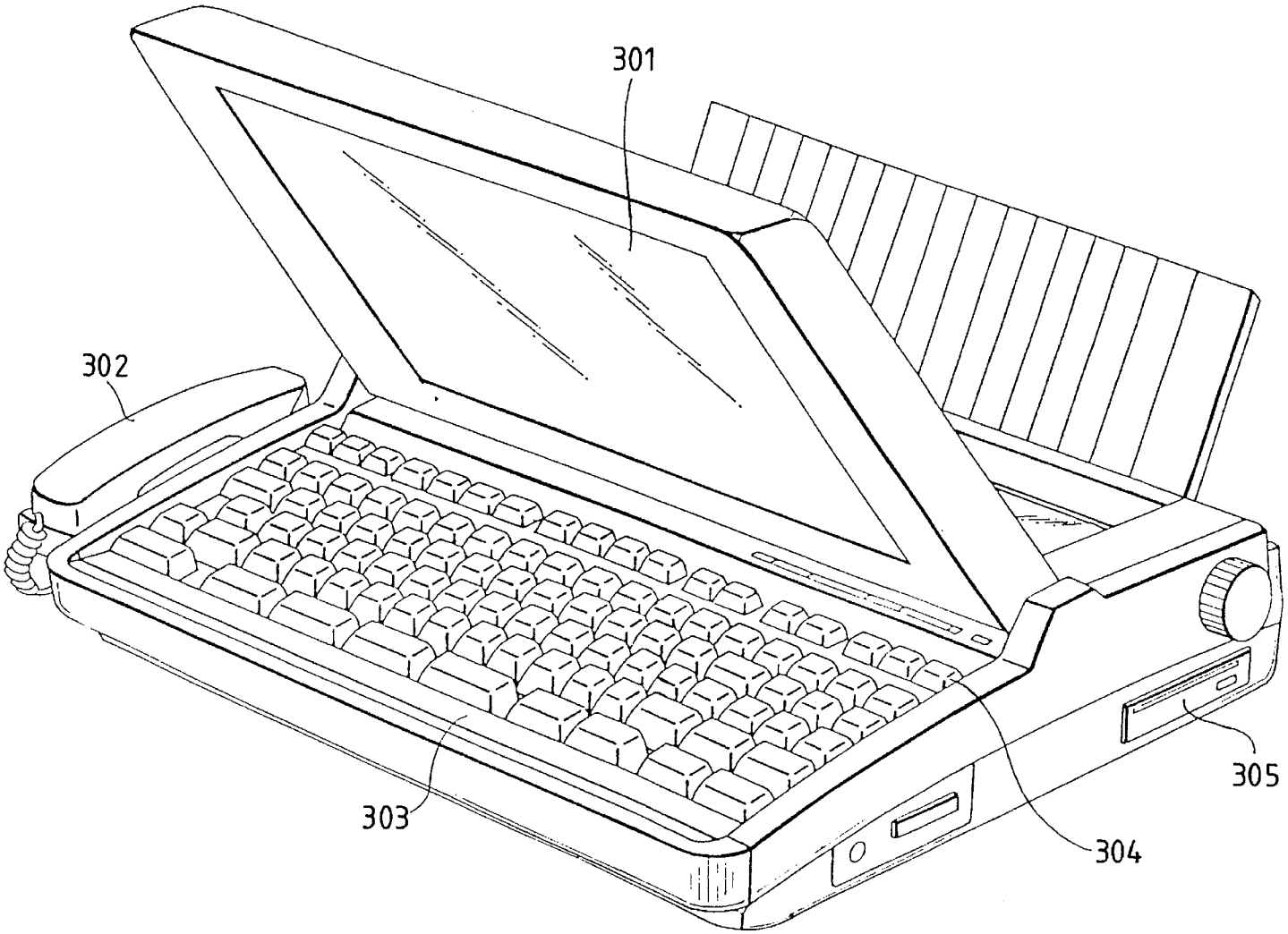
FIG. 19 is an external view showing another example of an information processing device.

It should be noted that the above mentioned information processing device can be an integral type containing an ink jet printer within the main body, as shown in FIG. 19, in which its portability can be enhanced. In the same figure, like reference numerals are affixed to parts having the same functions as those in FIG. 18.

As above described, if a recording apparatus according to the present invention is applied to the multifunction information processing device as above described, higher quality recording images can be obtained so that the functions of the information processing device can be further improved.

We claim:

1. A recording head attachable to a recording apparatus, said recording head comprising:

an ink discharge section having a plurality of recording elements for discharging ink;

a common liquid chamber in communication with said ink discharge section for storing ink to be supplied to said ink discharge section, with said common liquid chamber connecting said ink discharge section with an ink storage container; and a heat generating element provided within said common liquid chamber for receiving a predetermined electrical signal output at a predetermined time from a control section of the recording apparatus, wherein said heat generating element is an electrical resistor which generates heat by conducting electricity and has an electrical resistance varying with temperature, and wherein said heat generating element breaks if no ink exists in the vicinity of said heat generating element, and does not break if ink exists in the vicinity of said heat generating element.

2. A recording head according to claim 1, wherein said recording elements are discharge energy generating elements for discharging ink through discharge ports of said recording head, said discharge energy generating elements having heat-electricity converters for generating heat energy to discharge the ink through the discharge ports.

3. A recording head according to claim 2, further comprising an ink storage container integral with said liquid chamber, and wherein said recording head is a cartridge detachable from the recording apparatus.

4. A recording head according to claim 1, wherein said recording elements are discharge energy generating elements for discharging ink through discharge ports of said recording head, said discharge energy generating elements having heat-electricity converters for generating heat energy to cause film boiling in the ink to discharge ink through discharge ports with the growth of bubbles due to said film boiling.

5. A recording head according to claim 4, further comprising an ink storage container integral with said common liquid chamber, and wherein said recording head is a cartridge detachable from the recording apparatus.

6. A recording head according to claim 1, further comprising an ink storage container integral with said common liquid chamber, and wherein said recording head is a cartridge detachable from the recording apparatus.

7. A recording head according to claim 6, wherein said ink storage container contains ink.

8. A recording head according to claim 1, wherein a volume V of ink remaining in said common liquid chamber is within 1 $mm^3 \leqq V \leqq 100\ mm^3$ when said heat generating element is broken.

9. A recording head according to claim 1, wherein a plurality of said heat generating elements are provided and said heat generating elements are broken in succession each time the ink decreases beyond a predetermined amount.

10. A recording apparatus for recording with a recording head including an ink discharge section having a plurality of recording elements for discharging ink, a common liquid chamber in communication with said ink discharge section for storing ink to be supplied to said ink discharge section, with said common liquid chamber connecting said ink discharge section with an ink storage container, and a heat generating element provided within said common liquid chamber for receiving a predetermined electrical signal, wherein said heat generating element breaks if no ink exists in the vicinity of said heat generating element, and does not break if ink exists in the vicinity of said heat generating element, said apparatus comprising:

a control section for applying the predetermined electrical signal at a predetermined time to said heat generating element; and an ink detector for detecting the presence of ink based on whether or not said heat generating element is broken, wherein said heat generating element is an electrical resistor which generates heat by conducting electricity and has an electrical resistance varying with temperature.

11. A recording apparatus according to claim 10, wherein said ink detector detects the presence of ink within said common liquid chamber based on a change in electrical resistance of said electrical resistor.

12. A recording apparatus according to claims 10, wherein said recording elements are discharge energy generating elements for discharging ink through discharge ports of said recording head, said discharge energy generating elements having heat-electricity convectors for generating heat energy to discharge the ink through the discharge ports.

13. A recording apparatus according to claim 10, wherein said recording elements are discharge energy generating elements for discharging ink through discharge ports of said recording head, said discharge energy generating elements having heat-electricity convertors for generating heat energy to cause film boiling in the ink to discharge ink through said discharge ports with the growth of bubbles due to said film boiling.

14. A recording apparatus according to claim 10, wherein said common liquid chamber of said recording head communicates with an ink storage container separately provided.

15. A recording apparatus according to claim 10, wherein said heat generating element is a memory medium for storing the exhaustion of ink as a breakage of said heat generating element, and said ink detector detects the presence of ink within said common liquid chamber based on the information obtained from said memory medium.

16. A recording apparatus according to claim 10, wherein a volume V of ink remaining in said common liquid chamber is within 1 $mm^3 \leqq V \leqq 100\ mm^3$ when said heat generating element is broken.

17. A recording apparatus according to claim 10, wherein a plurality of said heat generating elements are provided and said heat generating elements are broken in succession each time the ink decreases beyond a predetermined amount.

18. A recording apparatus according to claim 10, wherein said heat generating element is driven by an electrical pulse.

19. A method for preventing recording commencement in a state when ink is not present in a recording head having an ink discharge section, said method comprising the steps of:

providing a heat generating element in said recording head for contacting ink therein, said heat generating element being an electrical resistor which generates heat by conducting electricity and having an electrical resistance varying with temperature;

providing temperature detecting means in said recording head;

discharging ink from said ink discharge section not for recording and before recording is commenced; and detecting the presence and absence of ink in said recording head in association with said discharging step by detecting a temperature change using said temperature detecting means when said heat generating element generates heat.

20. A method according to claim 19, wherein said detecting step is performed immediately after said discharging step.

21. An image forming apparatus for recording with a recording head, said apparatus comprising:

an ink discharge section having a plurality of recording elements for discharging ink;

a common liquid chamber in communication with said ink discharge section for storing ink to be supplied to said ink discharge section;

an ink storage container connected to said ink discharge section by said common liquid chamber;

a heat generating element provided within said common liquid chamber for receiving a predetermined electrical signal, wherein said heat generating element is an electrical resistor which generates heat by conducting electricity and has an electrical resistance varying with temperature, and wherein said heat generating element breaks if no ink exists in the vicinity of said heat generating element, and does not break if ink exists in the vicinity of said heat generating element;

a control section connected to said heat generating element for applying the predetermined electrical signal at a predetermined time to said heat generating element;

an ink detector connected to said control section for detecting the presence of ink based on whether or not said heat generating element is broken; and means, connected to said control section, for transmitting image information.

22. An image forming apparatus according to claim 21, further comprising means for reading an original image.

23. An image forming apparatus for recording with a recording head, said apparatus comprising:

an ink discharge section having a plurality of recording elements for discharging ink;

a common liquid chamber in communication with said ink discharge section for storing ink to be supplied to said ink discharge section;

an ink storage container connected to said ink discharge section by said common liquid chamber;

a heat generating element provided within said common liquid chamber for receiving a predetermined electrical signal, wherein said heat generating element is an electrical resistor which generates heat by conducting electricity and has an electrical resistance varying with temperature, and wherein said heat generating element breaks if no ink exists in the vicinity of said heat generating element, and does not break if ink exists in the vicinity of said heat generating element;

a control section connected to said heat generating element for applying the predetermined electrical signal at a predetermined time to said heat generating element;

an ink detector connected to said control section for detecting the presence of ink based on whether or not said heat generating element is broken; and means, connected to said control section, for receiving image information.

24. An image forming apparatus according to claim 23, further comprising means for reading an original image.

25. An image forming apparatus for recording with a recording head, said apparatus comprising:

an ink discharge section having a plurality of recording elements for discharging ink;

a common liquid chamber in communication with said ink discharge section for storing ink to be supplied to said ink discharge section;

an ink storage container connected to said ink discharge section by said common liquid chamber;

a heat generating element provided within said common liquid chamber for receiving a predetermined electrical signal, wherein said heat generating element is an electrical resistor which generates heat by conducting electricity and has an electrical resistance varying with temperature, and wherein said heat generating element breaks if no ink exists in the vicinity of said heat generating element, and does not break if ink exists in the vicinity of said heat generating element;

a control section connected to said heat generating element for applying the predetermined electrical signal at a predetermined time to said heat generating element;

an ink detector connected to said control section for detecting the presence of ink based on whether or not said heat generating element is broken; and means, connected to said control section, for reading an original image.

26. A recording apparatus according to claim 25, further comprising input means for inputting a recording signal.

27. A recording apparatus according to claim 26, wherein said input means is a keyboard.

28. An information processing apparatus for recording with a recording head, said apparatus comprising:

an ink discharge section having a plurality of recording elements for discharging ink;

a common liquid chamber in communication with said ink discharge section for storing ink to be supplied to said ink discharge section;

an ink storage container connected to said ink discharge section by said common liquid chamber;

a heat generating element provided within said common liquid chamber for receiving a predetermined electrical signal, wherein said heat generating element is an electrical resistor which generates heat by conducting electricity and has an electrical resistance varying with temperature, and wherein said heat generating element breaks if no ink exists in the vicinity of said heat generating element, and does not break if ink exists in the vicinity of said heat generating element;

a control section connected to said heat generating element for applying the predetermined electrical signal at a predetermined time to said heat generating element;

an ink detector connected to said control section for detecting the presence of ink based on whether or not said heat generating element is broken; and calculation processing means, connected to said control section, for processing information to be recorded.

29. A recording apparatus comprising:

an ink jet head for discharging ink, said ink head including a plurality of discharge energy generating means for discharging ink through discharge ports, a common liquid chamber in communication with the discharge ports to supply ink and for temporarily storing ink supplied from an ink storing reservoir, said ink storing reservoir exchangeably mounted on said recording apparatus, and a plurality of heat generating elements provided within said common liquid chamber for receiving a predetermined electrical signal, said heat generating elements breaking if no ink exists in the vicinity of said heat generating elements, and not breaking if ink exists in the vicinity of said heat generating elements;

detecting means for detecting among said heat generating elements a working heat generating element;

a control section for applying the predetermined electrical signal at a predetermined time to said working heat generating element; and ink detecting means for detecting the presence and absence of ink in said common liquid chamber in accordance with whether said heat generating element applied with said predetermined electrical signal breaks at said control section, wherein said heat generating element is an electrical resistor which generates heat by conducting electricity and has an electrical resistance varying with temperature.

30. A recording apparatus according to claim 29 further comprising information means for indicating that said ink storing reservoir should be exchanged when said ink detecting means detects that ink is absent.

31. A recording apparatus according to claim 29, further comprising information means for indicating that said ink storing reservoir should be exchanged when among said working heat generating elements is detected.

32. A recording apparatus according to claim 29, wherein said discharge energy generating means are heat-electricity convertors for generating heat energy to discharge ink through the discharge ports of said ink jet head.

33. A recording apparatus according to claim 29, wherein said discharge energy generating means generates heat energy to cause film boiling in the ink to discharge the ink through the discharge ports of said ink jet head with the growth of bubbles due to the film boiling.

34. A recording apparatus according to claim 29, wherein said ink jet head is comprised of a cartridge detachable from said recording apparatus.

35. A recording apparatus according to claim 29, wherein a volume V of ink remaining in said common liquid chamber is within 1 $mm^3 \leqq V \leqq 100\ mm^3$ when said heat generating element is broken.

36. A recording apparatus according to claim 29, wherein said heat generating elements are broken in succession each time the ink decreases beyond a predetermined amount.

37. A recording apparatus according to claim 29, wherein said ink storing reservoir contains ink.

38. A method for detecting ink in a recording apparatus having an ink jet head for discharging ink, with the ink jet head including a plurality of discharge energy generating means for discharging ink through discharge ports of the ink jet head, a common liquid chamber in communication with the discharge ports of the ink jet head to supply ink and for temporarily storing ink supplied from an ink storing reservoir, the ink storing reservoir exchangeably mounted on the recording apparatus, and a plurality of heat generating elements, wherein the heat generating elements are electrical resistors which generate heat by conducting electricity and have an electrical resistance varying with temperature, provided within the common liquid chamber for receiving a predetermined electrical signal, the heat generating elements breaking if no ink exists in the vicinity of said heat generating elements, and not breaking if ink exists in the vicinity of the heat generating elements, said method comprising the steps of;

detecting among the heat generating elements a working heat generating element;

applying the predetermined electrical signal at a predetermined time to the working heat generating element; and detecting the presence and absence of ink in the common liquid chamber in accordance with whether the heat generating element applied with the predetermined electrical signal breaks, wherein the applied predetermined electrical signal breaks the working heat generating element by applying the electrical signal when ink is not present in the vicinity of the heat generating element.

39. A recording apparatus according to claim 38, wherein the discharge energy generating means are heat-electricity convertors for generating heat energy to discharge ink through the discharge ports of the ink jet head.

40. A recording apparatus according to claim 38, wherein the discharge energy generating means generates heat energy to cause film boiling in the ink to discharge the ink through the discharge ports of the ink jet head with the growth of bubbles due to the film boiling.

41. A recording apparatus according to claim 38, wherein the ink jet head is comprised of a cartridge detachable from said recording apparatus.

42. A recording apparatus according to claim 38, wherein a volume V of ink remaining in the common liquid chamber is within 1 $mm^3 \leqq V \leqq 100\ mm^3$ when the heat generating element is broken.

43. A recording apparatus according to claim 38, wherein a volume V of ink remaining in the common liquid chamber is within 1 $mm^3 \leqq V \leqq 100\ mm^3$ when the generating element is broken.

44. A recording apparatus according to claim 38, wherein the heat generating elements are broken in succession each time the ink decreases beyond a predetermined amount.

45. A recording apparatus according to claim 38, wherein the ink storing reservoir contains ink.

* * * * *

UNITED STATES PATENT AND TRADEMARK OFFICE

CERTIFICATE OF CORRECTION

PATENT NO. : 5,617,121

DATED : April 1, 1997

INVENTOR(S) : MASAYOSHI TACHIHARA, ET AL.

It is certified that error appears in the above-identified patent and that said Letters Patent is hereby corrected as shown below:

COLUMN 2

Line 9, "following" should read --the following--;
Line 23, "until its full amount" should read --fully--; and
Line 30, "until its full amount" should read --fully--.

COLUMN 3

Line 66, "for-reserving" should read --for reserving--.

COLUMN 5

Line 55, "head" should read --head,--.

COLUMN 11

Line 59, "broke," should read --is broken,--; and
Line 65, "microcomuter" should read --microcomputer--.

COLUMN 12

Line 1, "program" should read --programs--.

COLUMN 14

Line 50, "(R9+R10)" should read --(R9+R10)/R10--.

UNITED STATES PATENT AND TRADEMARK OFFICE

CERTIFICATE OF CORRECTION

PATENT NO. : 5,617,121

DATED : April 1, 1997

INVENTOR(S) : MASAYOSHI TACHIHARA, ET AL.

It is certified that error appears in the above-identified patent and that said Letters Patent is hereby corrected as shown below:

COLUMN 15

Line 24, "$T_1$," should read --$Tr_1$,--; and
Line 59, "cope with" should read --cope--.

COLUMN 17

Line 31, "forth" should read --fourth--.

COLUMN 18

Line 10, "base" should read --case--; and
Line 56, "as-previously" should read --as previously--.

COLUMN 20

Line 28, "another" should read --other--;
Line 29, "type" should read --types--;
Line 31, "stable" should read --a stable--; and
Line 57, "the temperature up," should read --temperature increase,--.

COLUMN 23

Line 4, "said liquid" should read --said common liquid--.

UNITED STATES PATENT AND TRADEMARK OFFICE

CERTIFICATE OF CORRECTION

PATENT NO. : 5,617,121

DATED : April 1, 1997

INVENTOR(S) : MASAYOSHI TACHIHARA, ET AL. Page 3 of 3

It is certified that error appears in the above-identified patent and that said Letters Patent is hereby corrected as shown below:

COLUMN 26

Line 48, "breaks" should read --by--; and
Line 49, "at" should be deleted and "section," should read --section breaks,--.

Signed and Sealed this

Thirtieth Day of September, 1997

*Attest:*

Bruce Lehman

BRUCE LEHMAN

*Attesting Officer*

*Commissioner of Patents and Trademarks*